US008860328B2

(12) United States Patent
McRae

(10) Patent No.: US 8,860,328 B2
(45) Date of Patent: Oct. 14, 2014

(54) METHOD AND APPARATUS FOR CONTROLLING A MULTI-COLORED LED LIGHT STRING

(71) Applicant: Michael M. McRae, Ormond Beach, FL (US)

(72) Inventor: Michael M. McRae, Ormond Beach, FL (US)

(73) Assignee: National Christmas Products

( * ) Notice: Subject to any disclaimer, the term of this patent is extended or adjusted under 35 U.S.C. 154(b) by 97 days.

(21) Appl. No.: 13/694,754

(22) Filed: Dec. 31, 2012

(65) Prior Publication Data

US 2013/0313988 A1 Nov. 28, 2013

Related U.S. Application Data

(60) Provisional application No. 61/631,200, filed on Dec. 29, 2011.

(51) Int. Cl.
*H05B 37/02* (2006.01)
*H05B 33/08* (2006.01)

(52) U.S. Cl.
CPC ..... *H05B 37/02* (2013.01); *H05B 33/0857* (2013.01); *H05B 33/0803* (2013.01)
USPC ..... 315/294; 315/312; 315/315; 315/193; 315/211; 315/226; 362/227; 362/249.02; 362/249.06; 307/115

(58) Field of Classification Search
CPC .... H05B 37/02; H05B 37/029; H05B 37/036; H05B 33/0803; H05B 33/0857; F21S 4/001; F21S 9/04; F21Y 2101/02; F21W 2121/04; A63B 2207/02
USPC ..... 315/185 R, 185 S, 193, 211, 139, 216, 315/217, 226, 294, 312, 315, 318; 362/227, 362/231, 249.02, 249.06, 253; 307/112, 307/115
See application file for complete search history.

(56) References Cited

U.S. PATENT DOCUMENTS

| | | | | |
|---|---|---|---|---|
| 4,215,277 | A * | 7/1980 | Weiner et al. | 307/41 |
| 7,029,145 | B2 * | 4/2006 | Frederick | 362/234 |
| 2010/0141161 | A1 * | 6/2010 | Hering et al. | 315/185 S |
| 2014/0077711 | A1 * | 3/2014 | McRae | 315/193 |

* cited by examiner

*Primary Examiner* — Haiss Philogene
(74) *Attorney, Agent, or Firm* — Brian K. Johnson, Esq., LLC

(57) ABSTRACT

A method and apparatus for controlling a light string is provided. A controller is coupled to the light string and is used to bias one or more of the multicolor LEDs within each bulb on the light string. Using a prearranged determination of 1) the multicolor LEDs within each bulb, 2) the placement of the bulbs within the light string, and 3) the proper biasing of the plurality of leads within the light string, the controller can be used to change the entire light string from one complex holiday color scheme to another using a simple switching mechanism to select from one a of a plurality of desired color schemes.

18 Claims, 24 Drawing Sheets

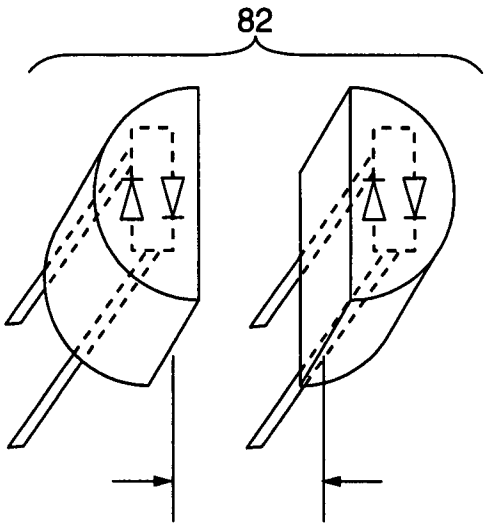
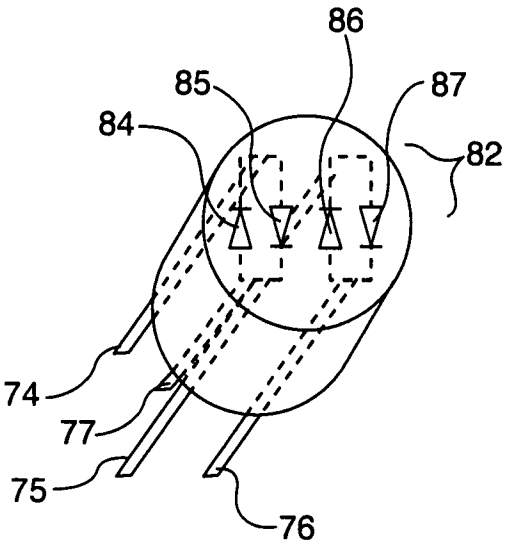
FIG. 2A

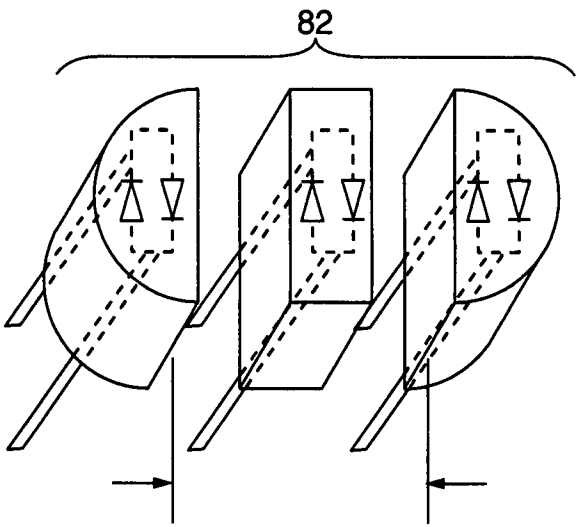
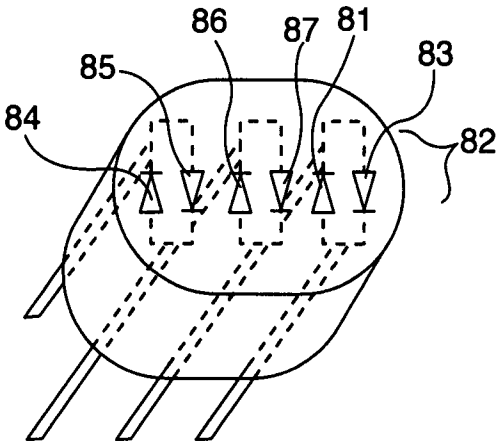
FIG. 2B

200

| ALL HOLIDAY 4 COLOR LED LIGHTING FOR SPECIFIC HOLIDAY PATTERNS | | | | | | | | |
|---|---|---|---|---|---|---|---|---|
| | | | 220 | | | | | |
| | | FOUR LEDS PER LIGHTING ELEMENT | | | | | | |
| HOLIDAY/SWITCH POSITION | CHRISTMAS 1 | PATRIOTIC 2 | EVERYDAY 3 | MARDI GRAS 4 | HALLOWEEN 5 | EASTER 6 | SCHOOL COLORS 7 | ALT. EASTER 8 |
| String LED Bulb Number | LED Bulb Segment LED "A" | LED Bulb Segment LED "B" | LED Bulb Segment LED "C" | LED Bulb Segment LED "D" | LED Bulb Segment LED "A & D" | LED Bulb Segment LED "A & C" | LED Bulb Segment LED "A & B" | LED Bulb Segment LED "B & C" |
| 1 | RED | RED | WHITE | YELLOW | ORANGE | PINK | BRIGHT RED | LIGHT YELLOW |
| 2 | BLUE | WHITE | WHITE | PURPLE | LIGHT PURPLE | LIGHT BLUE | LIGHT BLUE | LIGHT PURPLE |
| 3 | GREEN | BLUE | WHITE | GREEN | TURQUOIS | LIGHT GREEN | TURQUOIS | LIGHT BLUE |
| 4 | YELLOW | WHITE | WHITE | ORANGE | ORANGE | LIGHT YELLOW | LIGHT YELLOW | WHITE |
| 5 | RED | RED | WHITE | YELLOW | ORANGE | PINK | BRIGHT | LIGHT YELLOW |
| 6 | BLUE | WHITE | WHITE | PURPLE | LIGHT PURPLE | LIGHT BLUE | LIGHT BLUE | LIGHT PURPLE |
| 7 | GREEN | BLUE | WHITE | GREEN | TURQUOIS | LIGHT GREEN | TURQUOIS | LIGHT BLUE |
| 8 | YELLOW | WHITE | WHITE | ORANGE | ORANGE | LIGHT YELLOW | LIGHT YELLOW | WHITE |

241 242

260

FIG. 5A

300

| ALL HOLIDAY 6 COLOR LED LIGHTING FOR SPECIFIC HOLIDAY PATTERNS | | | | | | | | | | |
|---|---|---|---|---|---|---|---|---|---|---|
| | | | | | 320 | | | | | |
| | | SIX LEDS PER LIGHTING ELEMENT | | | | | | | | |
| HOLIDAY/ SWITCH POSITION | CHRISTMAS 1 | U.S. PATRIOTIC 2 | EVERYDAY 3 | MARDI GRAS 4 | HALLOWEEN 5 | ITALIAN 6 | HALLOWEEN 7 | EASTER 8 | SCHOOL COLORS 9 | ALT. EASTER 10 |
| String LED Bulb Number | LED Bulb Segment LED "A" | LED Bulb Segment LED "B" | LED Bulb Segment LED "C" | LED Bulb Segment LED "D" | LED Bulb Segment LED "E" | LED Bulb Segment LED "F" | LED Bulb Segment LED "A & D" | LED Bulb Segment LED "A & C" | LED Bulb Segment LED "A & B" | LED Bulb Segment LED "B & C" |
| 1 | RED | RED | WHITE | YELLOW | ORANGE | RED | ORANGE | PINK | BRIGHT RED | LIGHT YELLOW |
| 2 | BLUE | WHITE | WHITE | PURPLE | PURPLE | WHITE | LIGHT PURPLE | LIGHT BLUE | LIGHT BLUE | LIGHT PURPLE |
| 3 | GREEN | BLUE | WHITE | GREEN | ORANGE | GREEN | TURQUOIS | LIGHT GREEN | TURQUOIS | LIGHT BLUE |
| 4 | YELLOW | WHITE | WHITE | ORANGE | PURPLE | WHITE | ORANGE | LIGHT YELLOW | LIGHT YELLOW | WHITE |
| 5 | RED | RED | WHITE | YELLOW | ORANGE | RED | ORANGE | PINK | BRIGHT RED | LIGHT YELLOW |
| 6 | BLUE | WHITE | WHITE | PURPLE | PURPLE | WHITE | LIGHT PURPLE | LIGHT BLUE | LIGHT BLUE | LIGHT PURPLE |
| 7 | GREEN | BLUE | WHITE | GREEN | ORANGE | GREEN | TURQUOIS | LIGHT GREEN | TURQUOIS | LIGHT BLUE |
| 8 | YELLOW | WHITE | WHITE | ORANGE | PURPLE | WHITE | ORANGE | LIGHT YELLOW | LIGHT YELLOW | WHITE |

360 344

FIG. 5B

METHOD AND APPARATUS FOR CONTROLLING A MULTI-COLORED LED LIGHT STRING

CROSS REFERENCE TO RELATED APPLICATIONS

This application claims priority to and the benefit of U.S. Provisional Patent Application No. 61/631,200 filed Dec. 29, 2011 titled "Method and Apparatus for Controlling a Multi-colored LED light String" which is incorporated by reference herein in its entirety.

STATEMENT REGARDING FEDERALLY SPONSORED RESEARCH OR DEVELOPMENT

Not applicable.

BACKGROUND OF THE INVENTION

The patent relates generally to an apparatus and method for controlling multi-color LED light strings. To date, none of the existing LED light string controllers have an easy and convenient mechanism for displaying preset patters of colored LED lights corresponding to particular holidays.

Prior art systems have attempted to control light string in a variety of other ways. For example, U.S. Pat. No. 6,653,797, titled Apparatus and Method for Providing Synchronized Lights (hereinafter Puleo Sr. et al.), uses a digital controller to synchronize different light groups on a plurality of decorative lighting strings. In this patent, a master control unit is configured to control slave controllers so as to provide and pass through individual color signals to the plurality of light strings thereby illuminating the same color bulbs on each light string in the master-slave configuration. The bulbs of Puleo Sr. et al. are not multicolored such that a plurality of colors is available for controlling and there is only one control signal controls each color.

Thus, the prior art of LED light string controllers is lacking in certain aspects. In particular, none of the prior art discloses a controller used to easily and conveniently select LED light display patterns that correspond to prearranged lighting color schemes, particularly as they correspond to holiday lighting.

BRIEF SUMMARY OF THE INVENTION

In one preferred embodiment, the invention is a lighting system that includes a controller coupled to a power source at a first connection and at least one light string at a second connection, the second connection including at least three connection leads, the second connection being polarized such that the light string is capable of only one connection orientation at the second connection, the light string containing a plurality of lighting elements, each of the lighting elements containing a plurality of different colored lights, the controller having a switch with a plurality of switch positions including: a first switch position for providing electrical power at the second connection to the light string by applying a first voltage phase on a first connection lead, the first voltage phase biasing a first light among the plurality of different colored lights within the lighting elements; a second switch position for providing electrical power at the second connection to the light string by applying a second voltage phase on the first connection lead, the second voltage phase biasing a second light among the plurality of different colored lights within the lighting elements; and a third switch position for providing electrical power at the second connection to the light string in a third voltage phase on a second connection lead, the third voltage phase biasing a third light among the plurality of different colored lights within the lighting elements.

In certain preferred aspects of the invention, the plurality of different colored lights are multicolored LEDs and the lighting element is a bulb containing the multicolored LEDs; a fourth switch position is disclosed for providing electrical power at the second connection to the light string by simultaneously applying the first voltage phase on the first connection lead and the second voltage phase on the second connection lead, the plurality of applied voltage phases biasing a plurality of the different colored lights within of the lighting elements; the lighting element includes a diffusion element for blending the colors of the plurality of biased lights. Additional aspects of the invention provide for sockets for receiving the lighting elements, the sockets and the lighting elements including an orientation mechanism used to govern the proper insertion of the lighting elements into the sockets; the connection mechanism permits a plurality of orientations of the light element within the socket; the controller includes a bypass switch position, the bypass switch position applying the same biasing voltages present at connection leads of the first connection to the connection leads of the second connection. In still other arrangements, the controller includes a rectifier for converting AC voltage input at the first connection to DC voltage to the switch for providing the biasing voltage phases; an adapter is included and used to convert the at least three connection leads to a standard two prong NEMA plug coupling to accommodate existing holiday decorations within the system; and an ornament including a plurality of lighting elements provided, each of the lighting elements containing a plurality of different colored lights, the ornament coupled to the controller at another second connection, a first, second and third light among the plurality of different colored lights being biased in combination with the first, second and third light among the plurality of different colored lights on the light string.

In another preferred embodiment, a light string is provided including: a connection including at least three connection leads, the connection being polarized such that the light string is capable of only one connection orientation to a controller, the light string containing a plurality of lighting elements, each of the lighting elements containing a plurality of different colored lights, the light string being operable by the controller wherein the controller has a switch with a plurality of switch positions including: a first switch position for providing electrical power at the second connection to the light string by applying a first voltage phase on a first connection lead, the first voltage phase biasing a first light among the plurality of different colored lights within the lighting elements; a second switch position for providing electrical power at the second connection to the light string by applying a second voltage phase on the first connection lead, the second voltage phase biasing a second light among the plurality of different colored lights within the lighting elements; and a third switch position for providing electrical power at the second connection to the light string in a third voltage phase on a second connection lead, the third voltage phase biasing a third light among the plurality of different colored lights within the lighting elements.

In certain variations of this arrangement, the light string includes plurality of different colored lights are multicolored LEDs and the lighting element is a bulb containing the multicolored LEDs; the controller includes a fourth switch position for providing electrical power at the connection to the light string by simultaneously applying the first voltage phase on the first connection lead and the second voltage phase on the second connection lead, the plurality of applied voltage phases biasing a plurality of the different colored lights within of the lighting elements; and the lighting element includes a diffusion element for blending the colors of the plurality of biased lights. In other invention variations, the light string includes sockets for receiving the lighting elements, the sockets and the lighting elements include an orientation mechanism used to govern the proper insertion of the lighting elements into the sockets; and the connection mechanism permits a plurality of orientations of the light element within the socket.

In a preferred method of operating the present the method includes coupling a controller to a power source at a first connection of the controller; coupling the controller to at least one light string at a second connection of the controller, the second connection includes at least three connection leads, the second connection being polarized such that the light string is capable of only one connection orientation at the second connection, the light string containing a plurality of lighting elements, each of the lighting elements containing a plurality of different colored lights, the controller having a switch with a plurality of switch positions; switching the controller to a first switch position, the first switch position provides electrical power at the second connection to the light string in a first voltage phase on a first connection lead, the first voltage phase biasing a first colored light within the plurality of different colored lights; switching the controller to a second switch position, the second switch position providing electrical power at the second connection to the light string in a second voltage phase on the first connection lead, the second voltage phase biasing a second colored light within the plurality of different colored lights; and switching the controller to a third switch position, the third switch position providing electrical power at the second connection to the light string in a third voltage phase on a second connection lead, the third voltage phase biasing a third colored light within the plurality of different colored lights.

In one particular aspect of the method, the method includes the step of switching the controller to a fourth switch position, the fourth switch position providing electrical power at the second connection to the light string by simultaneously applying the first voltage phase on the first connection lead and the second voltage phase on the second connection lead, the plurality of applied voltage phases biasing a plurality of the different colored lights within of the lighting elements.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIGS. 2A and 2B are perspective views of two light elements according to alternative embodiments of the invention;

FIGS. 5A & 5B are charts illustrating the color patterns displayed by the LED light elements according to particular embodiments of the invention;

DETAILED DESCRIPTION OF THE INVENTION

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

It is also to be understood that certain aspects of the present invention may be implemented in various forms of hardware, software, firmware, special purpose processors, or a combination thereof. Preferably, certain aspects of the present invention may be implemented in software as a program tangibly embodied on a program storage device. The program may be uploaded to, and executed by, a machine comprising any suitable architecture. Preferably, certain aspects of the invention are implemented on a computer platform having hardware such as one or more central processing units (CPU), a random access memory (RAM), and input/output (I/O) interface(s). The computer platform may also include an operating system and microinstruction code. The various processes and functions described herein may either be part of the microinstruction code or part of the program (or combination thereof) which is executed via the operating system. In addition, various other peripheral devices may be connected to the computer platform such as an additional data storage device and a printing device.

It is to be understood that, because some of the constituent system components and method steps depicted in the accompanying figures are preferably implemented in software, the actual connections between the system components (or the process steps) may differ depending upon the manner in which the present invention is programmed. Specifically, any of the computers or devices may be interconnected using any existing or later-discovered networking technology and may also all be connected through a lager network system, such as a corporate network, metropolitan network or a global network, such as the internet.

Figure 1A:
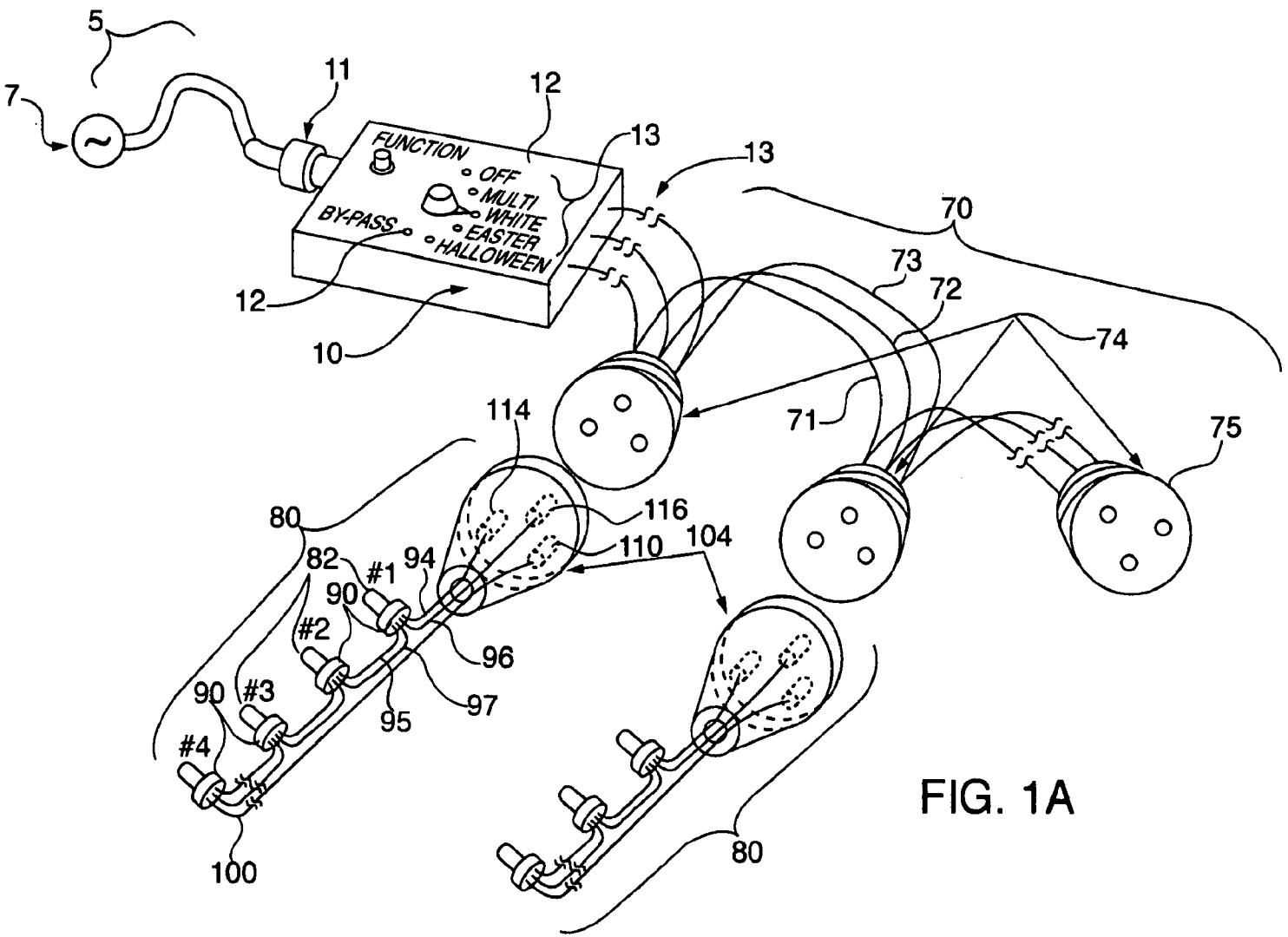
FIGS. 1A-1C are modular component views of the invention according to one preferred embodiment.

FIG. 1A shows a modular component view of the lighting system 5 of the present invention. Lighting system 5 includes a controller 10, light strings 80, and light string connections 70. The controller 10 is plugged into a power source 7 at a first connection 11. Power source 7 may be any of a plurality of power sources, including any AC or DC power source. In a typical commercial embodiment, power source 7 is a typical 115V AC power outlet as found in a residence or a building and the first connection 11 is coupled to that power source with a NEMA standard electrical power plug.

Controller 10 provides various switching functions to control the light strings 80 and is connected to the light strings at a second connection 13. Second connection 13 may be distributed to multiple light strings 80 by means of a distribution harness 70 having its own connectors 74 and 75 that connect to the light strings 80 at light string connections 104. Connectors 74, 75 and 104 may be comprised of any of the standard male-female mating systems typically used for making electrical connections for light strings. Further, connectors 74, 75 and 104 may be polarized so that only one connection orientation is possible in making the mating connection between the two. For this invention, however, a minimum of three control signals or leads are provided at the controller's second connection 13 and distributed to mating connector pairs 74 and 104 along wires 71, 72 and 73. The reason for this limitation will become clear as described in more detail below.

Functionally, controller 10 provides several electrical functions. First, controller 10 provides a switching function to control the illumination of light strings 80. Such illumination is provided by direct power transmission from power source 7 through controller 10 and over the wires 71, 72, and 73 of distribution harness 70. The switching functions of controller 10 include an off position 12, a bypass position 17, and a plurality of color selection positions 13. Regarding power management, controller 10 may include high-to-low voltage conversion functions and AC/DC conversion functions, as well as any other power management functions required by or desirably provided to the light strings 80.

Light strings 80 are connected to the distribution harness 70, or alternatively the controller 10 directly, at connectors 104. Light strings 80 include a plurality of light elements 82 each of which includes a plurality of lights within each light element. The lights within each light element may be incandescent, fluorescent, LED or any of a variety of other illumination technologies. In one particularly preferred embodiment, the lights within the light element include 4 or 6 LEDs of different colors.

Figure 1B:
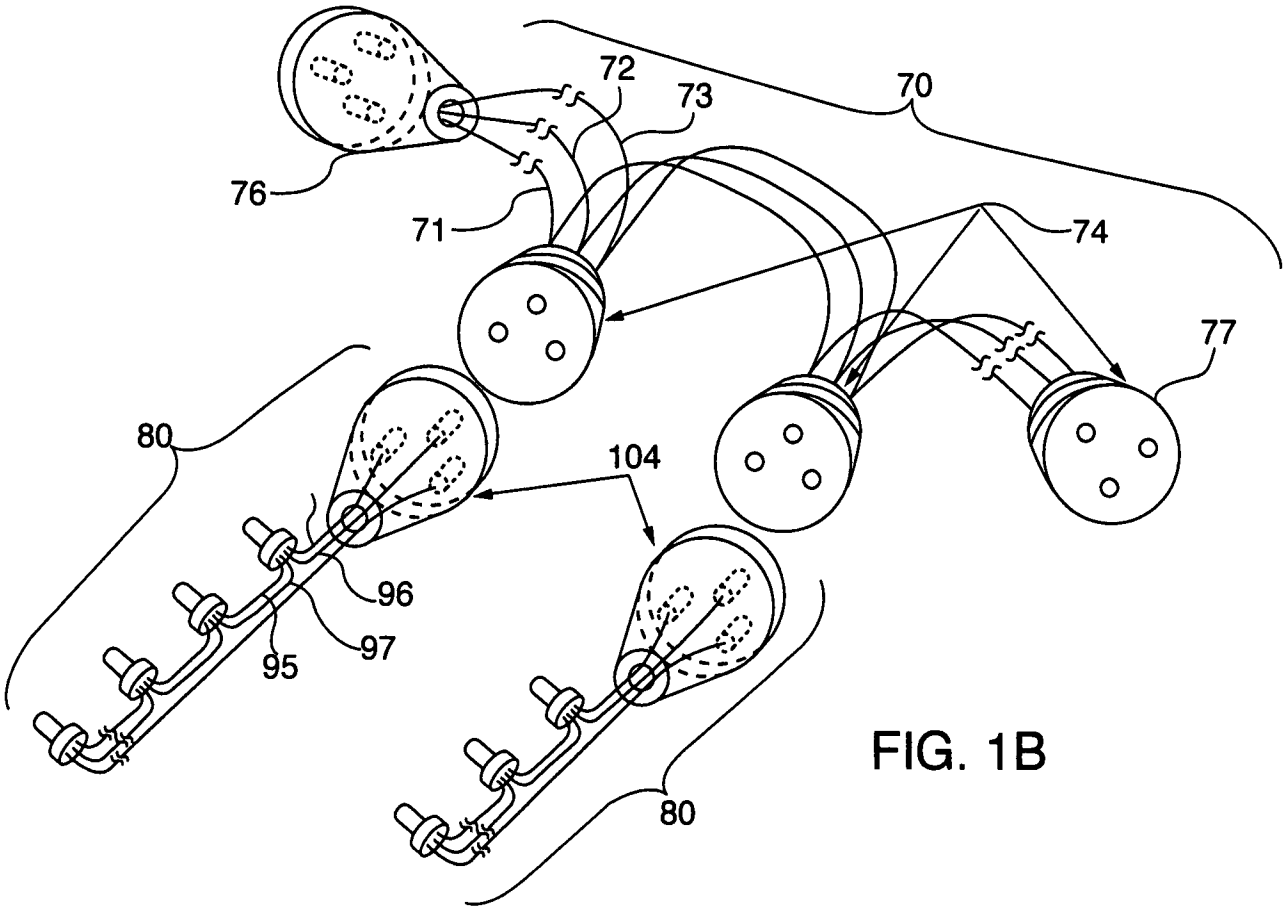
Figure 1C:
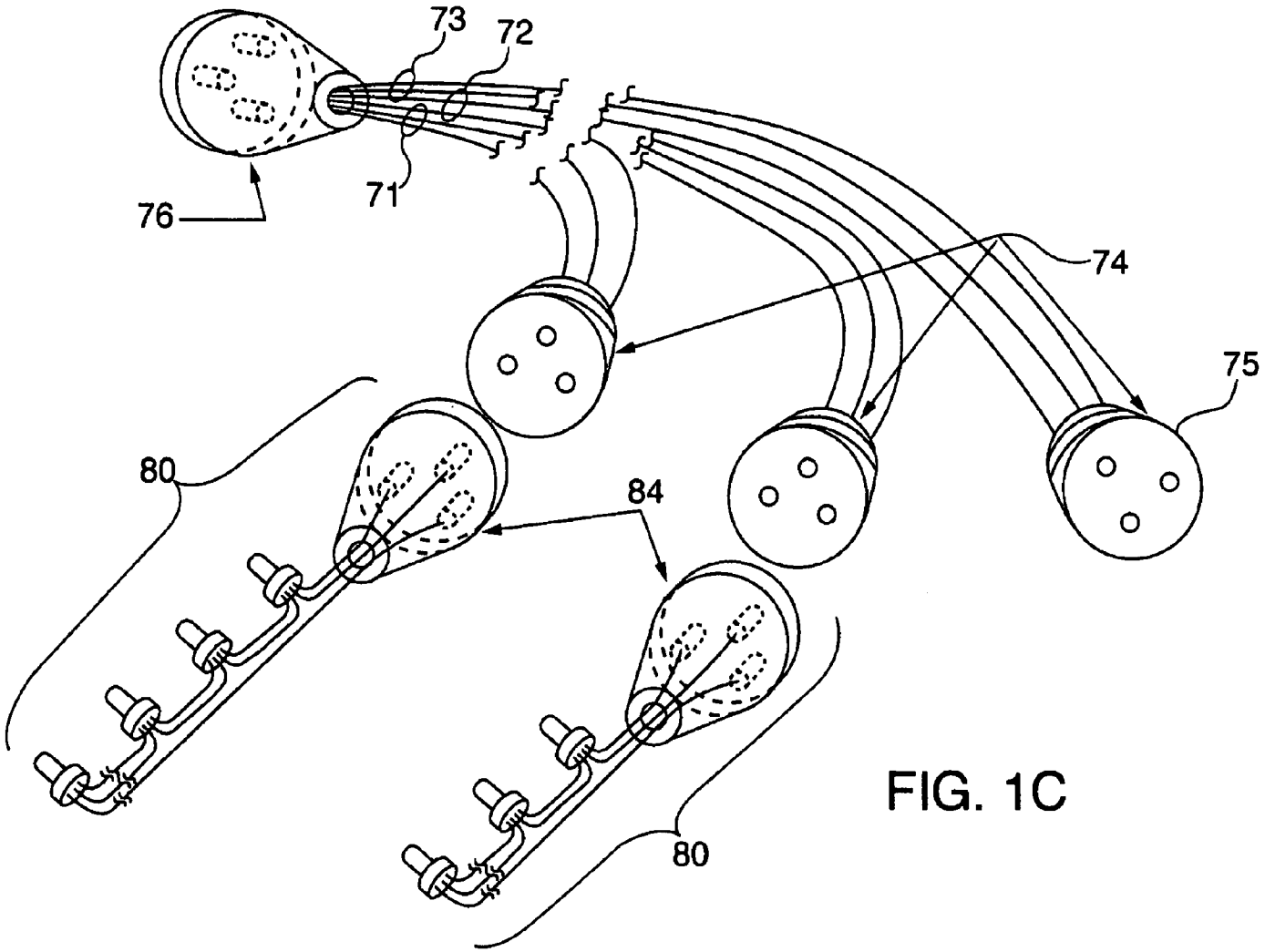

FIGS. 1B and 1C provide alternative configurations of the distribution harness 70 as used to couple additional light strings 80 to the controller 10 or to add-on connector 75 of FIG. 1A. FIG. 1B shows a distribution harness 70 that includes a male connector 76 used to mate with female add-on connector 75 of FIG. 1A and an additional female connector 77 for providing a connection to additional downstream distribution harnesses. Female connectors 74 are provided for connection to light strings 80 having male connectors 104. Connectors 76, 77 and 74 are provided with at least three leads 71, 72 and 73 which are physically connected in series from one connector to the next, so as to provide a parallel electrical connection coupling the three prong male connections at male connector 76 and the three prong female connectors 74 and 77. FIG. 1C shows a similar distribution harness with the difference being that the three leads 71, 72 and 73 are physically connected in a "Y" or parallel physical arrangement, from male connector 76 to directly to each of the other female connectors 74 and 77, so as to provide a parallel electrical connection coupling the three prong male connections at male connector 76 and the three prong female connectors 74 and 77. Thus, unlike the arrangement of FIG. 1B, there are bundles of the three leads 71, 72 and 73 providing the connections from male connector 76 to each of the female connectors 74 and 75.

In an alternative powering arrangement of FIGS. 1A-1C, the distribution harnesses or the light strings 80 themselves may each be plugged directly into a power source 7 so as to provide power to the light elements 82. In this arrangement, the control signals passed along leads 71, 72 and 73 may either be hardwired to each of the distribution harnesses, as previously described, or wirelessly transmitted by controller 10. In a wireless configuration, the harnesses and/or light strings would necessarily include wireless receivers and the controller would include a wireless transmitter (none of which are shown). Whether in a wireless or wired configuration, the controller may be physically composed of a separate piece of hardware, as shown in FIG. 1A, or may take the form of a hand-held electronic device or a computer.

FIGS. 2A and B provide a perspective view of the light elements 82 according to two preferred embodiments of the invention. In FIG. 2A, a four-LED light element is provided having individual LEDs 84, 85, 86, and 87. Each of the LEDs may be of a different color or may contain any of a variety of color combinations according to the holiday lighting needs of light strings 80. Pairs of the LEDs may be wired in parallel, but cross-connected, such that two leads 74 and 75 are needed to power each pair depending on the voltage polarity (phase) applied to the LED lead pairs. As shown in FIG. 2A, a positive voltage phase on LED lead 75 as compared to LED lead 74 will result in the illumination of LED 84, B. Revering that polarity will result in the illumination of LED 85, A. The same function is applicable to the two LED leads 76 and 77 coupled to cross-connected LEDs 86 and 87. In this manner of arrangement, the number of leads from the light elements 82 is reduced and 4 LEDs may be supported by four leads. Finally, as shown in FIG. 2A, the light element 82 containing the LEDs may be constructed as a single piece/housing (left side of FIG. 2A) or component pieces that are later assembled or affixed to one another to effectuate the appearance of a single light element (right side of FIG. 2A).

FIG. 2B discloses a light element 82 that includes six LEDs 81, 83, 84, 85, 86 and 87. In this arrangement, three LED lead pairs are required to provide the six individual voltage biases required to illuminate the six LEDs. Those of skill in the art will realize that AC voltages across any pair of LED leads in lighting element 82 will result in the illumination of both cross-connected LEDs connected to those leads. Further, the simultaneous DC biasing of two or more pairs of LED leads will result in the simultaneous illumination of multiple LEDs. In this fashion, more than four colors (in FIG. 2A) or six colors (in FIG. 2B) may be obtained from a single light element. In the example of FIG. 2B, if LED 84 is red and LED 87 is blue, the simultaneous illumination of these two LEDs will result in a purple color being emitted by light element 82. This effect can be enhanced by providing a diffuser within the LED housing/light element 82. Finally, as with the four-LED arrangement of FIG. 2A, the light element 82 containing the six LEDs may be constructed as a single piece/housing (left side of FIG. 2B) or component pieces that are later assembled or affixed to one another to effectuate the appearance of a single light element (right side of FIG. 2B).

Figure 3A:
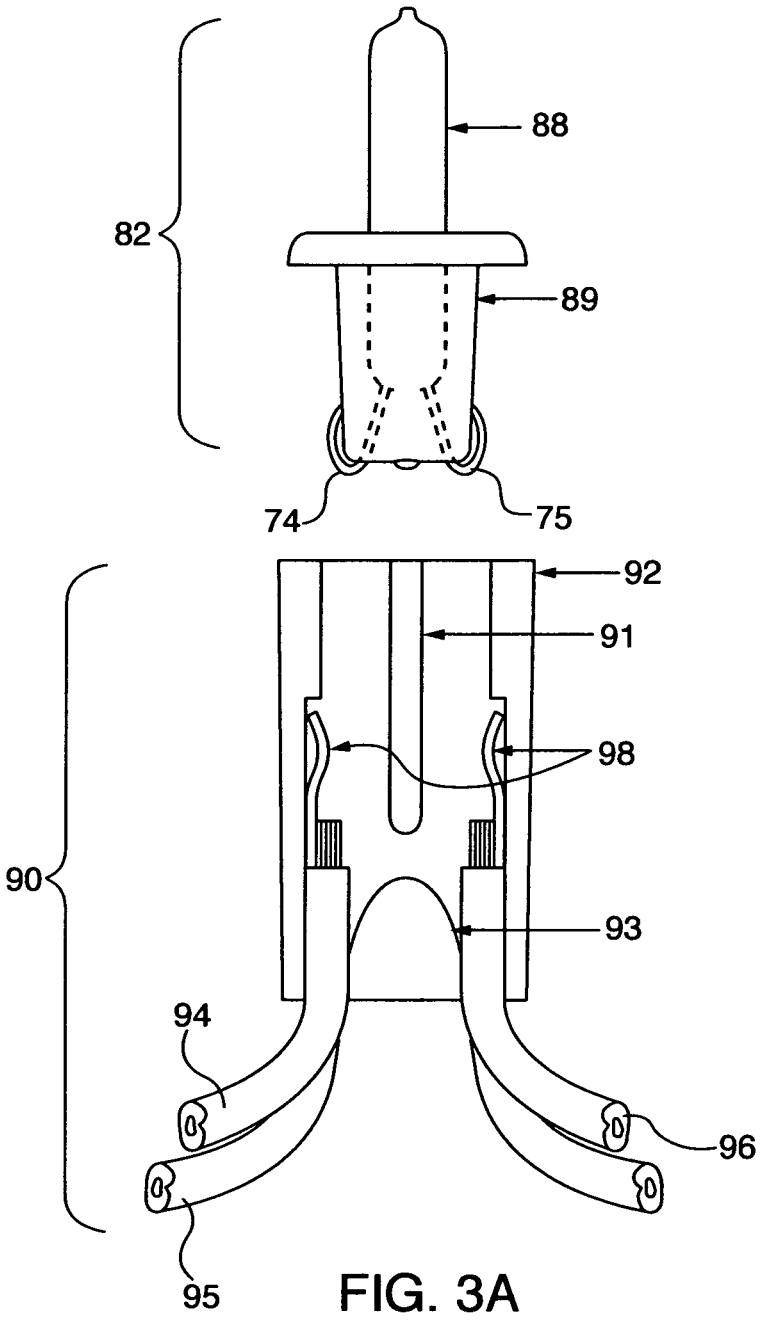
FIGS. 3A-3F are a sequential series of side, top and bottom views of the light elements and sockets according to several embodiments of the invention.

FIGS. 3A-3F show in a pair-wise fashion, cut away side views and top/bottom views of three light elements and their corresponding sockets. FIG. 3A shows a four LED light element 82 including base 89 and bulb 88, which houses the four LEDs shown in FIG. 2A. LED leads 74 and 75 are shown extruding from based 89. LED leads 76 and 77 are not shown but are present on the base backside. Four-LED socket 90 consists of a socket body 92, a terminal lock 93 and orientation slot 91. Four spring action terminals 98 are provided within the socket body for mateable connection with LED leads 74, 75, 76, and 77 when light base 89 is inserted into socket body 92. Spring action terminals are in turn electrically coupled to socket leads 94, 95, 96 and 97 which compose a portion of the wiring within light string 80.

Figure 3B:
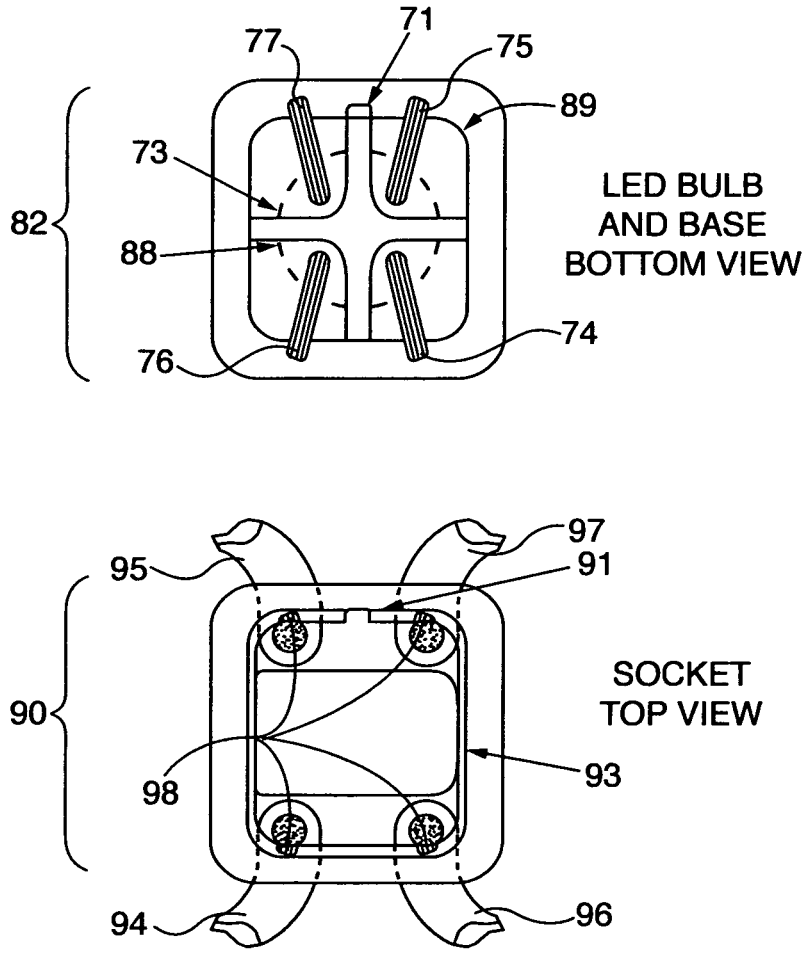

FIG. 3B provides the bottom view of the lighting element 82 (top image) and top view of socket 90 (bottom image). Square base 89 shows the bulb 88 as a hidden line circle with LED leads 74, 75, 76 and 77 protruding outward from the base bottom and wrapping up the side of the base 89. Lead separator 73 is provided to maintain separation of the LED leads. Orientation tab 71 is provided on one side of the base 89. Bulb 88 is shown as the hidden line circle. Regarding the bottom image, orientation slot 91 is shown on one inner face of socket 90. Terminal lock 93 is provided to lock the bulb base in place once fully inserted. Socket leads 94, 95, 96 and 97 are connected at one end to spring terminals 98 and are shown leading out of the socket 90 at its bottom end.

Referring back to FIG. 1, light string 80 is comprised of a plurality of light sockets 90 wired to light string connector 104. Leads 114 and 116 from light string connector 104 are wired to socket leads 94 and 96 respectively on the first in the series of sockets. First socket leads 95 and 97 are subsequently connected to socket leads 94 and 96 of the second socket. This wiring pattern is continued, socket to socket, until the last socket's terminals 94 and 96 are wired to the previous socket. It should be noted that the last socket in light string 80 is wired slightly differently in that socket leads 95 and 97 are wired together to provide one return ground 100 to terminal 110 of light string connector 104.

Upon insertion of all the light elements 82 into sockets 90 in light string 80 the three lead circuit of the light string is complete. With respect to FIG. 3B, LED leads 74, 75, 76, and 77 make electrical connection to spring terminals 98 and the four socket leads 94, 95, 96, and 97 respectively. It should be noted that the LEDs are arranged in the bulb such that LED pairs 84/85 and 86/87 are connected to LED lead pairs 74/75 and 76/77 respectively. Orientation tab 71 on base 89 is aligned with orientation slot 91 so that there is only one possible insertion orientation of the light element into the socket thereby ensuring that voltage bias applied across socket leads 94/95 and 96/97 result in biasing one of the four respective LEDs 84, 85, 86, 87. Thus, the LEDs are biased and thereby illuminated according to the following table:

| LIGHT STRING CONNECTOR LEAD | VOLTAGE WITH RESPECT TO GROUND 100 | LED BIASED (EACH BULB) |
|---|---|---|
| 114 | POSITIVE | 85 |
| 114 | NEGATIVE | 84 |
| 116 | POSITIVE | 86 |
| 116 | NEGATIVE | 87 |

Figure 3C:
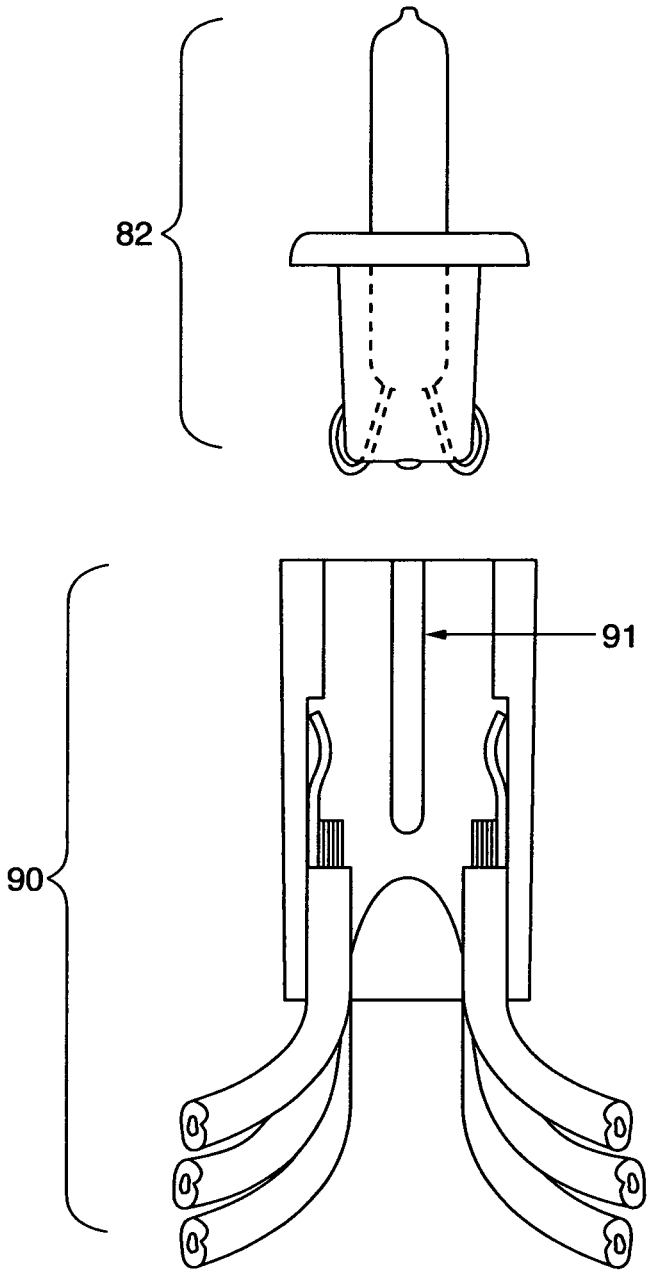
Figure 3D:
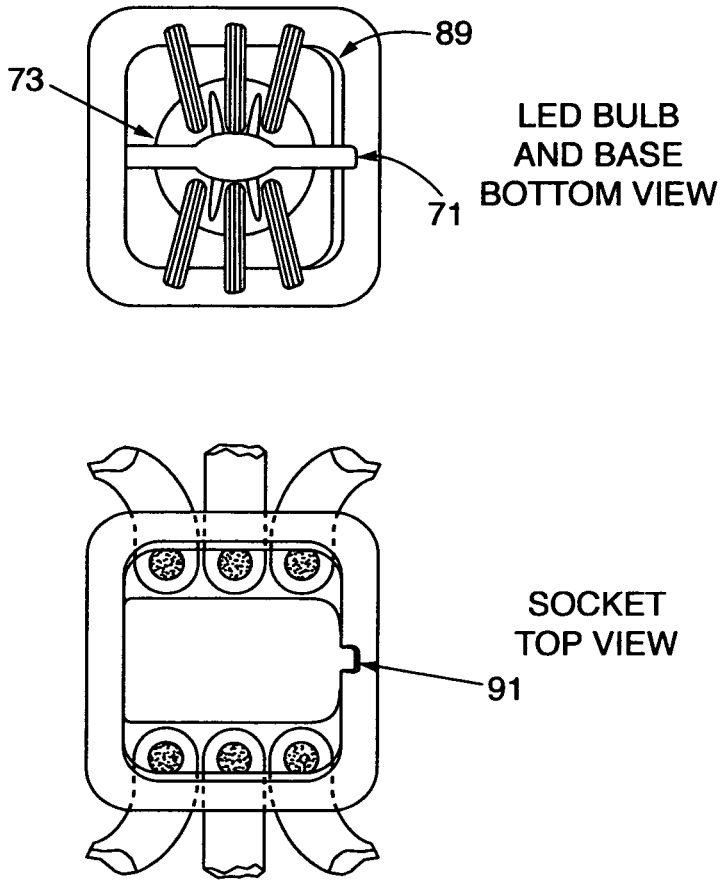

Referring to FIGS. 3C and 3D, a lighting element 82 and socket 90 are shown corresponding to the 6 LED light element. Most elements correspond similarly to those provided with respect to the 4 LED light element and socket including: the orientation slot 91 in the socket 90 of FIG. 3C, the orientation tab 71 and lead separator 73 on the light element base. As necessitated by the additional cross-connected LED pair, the number of LED leads on the base and corresponding socket leads to which they couple is increased from four to six as shown in FIG. 3D. Likewise the light string used to illuminate the 6 LED lighting elements will include a light string connector possessing four leads, three to bias the 3 LED pairs and the fourth as a return ground on the string.

Figure 3E:
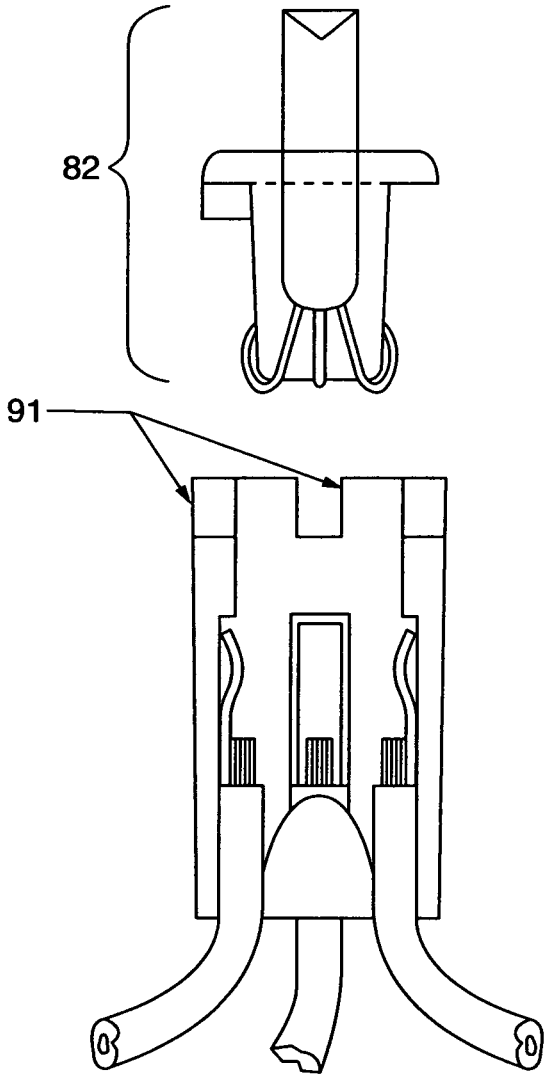
Figure 3F:
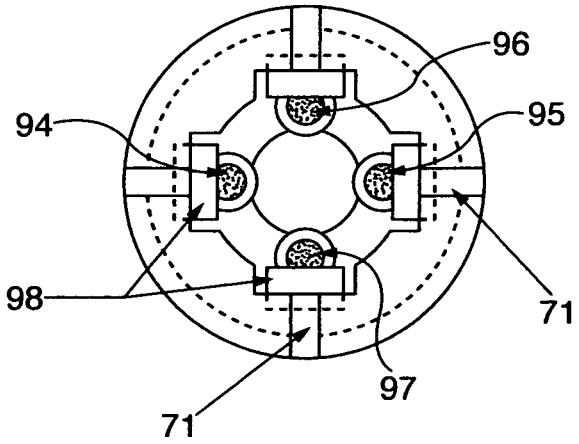

Those of skill in the art will recognize that alternative orientations of the light element within the socket will allow for a single light element containing multiple LED pairs to be used in the same socket to provide different color schemes. Referring to FIGS. 3E and 3F, the use of multiple orientation slots (or keys) 91 on socket 90 in connection with a 90-degree symmetrical socket are disclosed. This arrangement allows for the light element base to be inserted into the socket in any one of for possible orientations according to the keyed availability. It should be appreciated that the available keying combinations will be dependent on the orientation of the LEDs presented within the bulb, since the electrical connections to the socket leads remain unchanged.

Figure 4A:
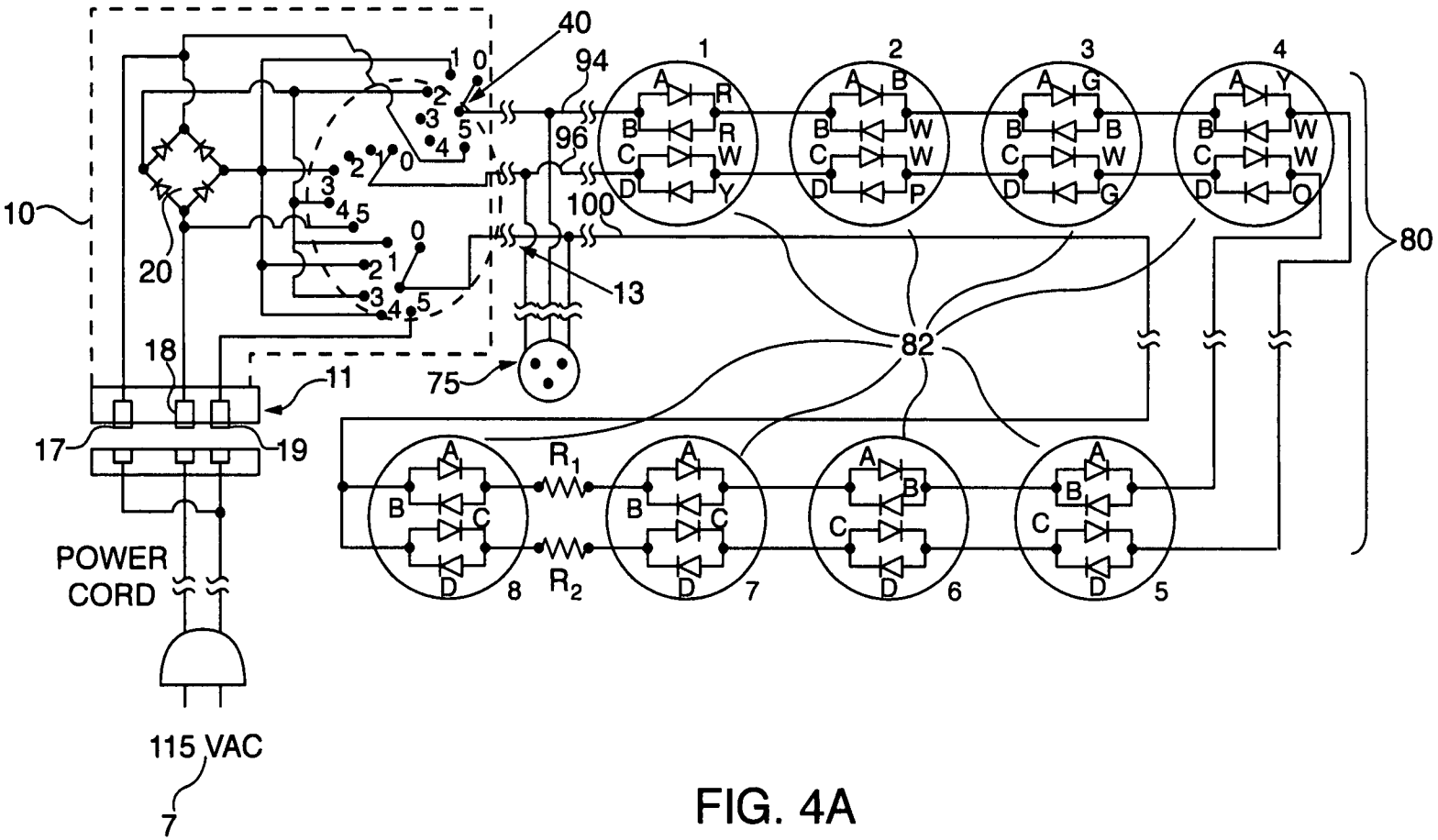
FIGS. 4A & 4B are circuit diagrams of the invention according to several embodiments of the invention.
Figure 4B:
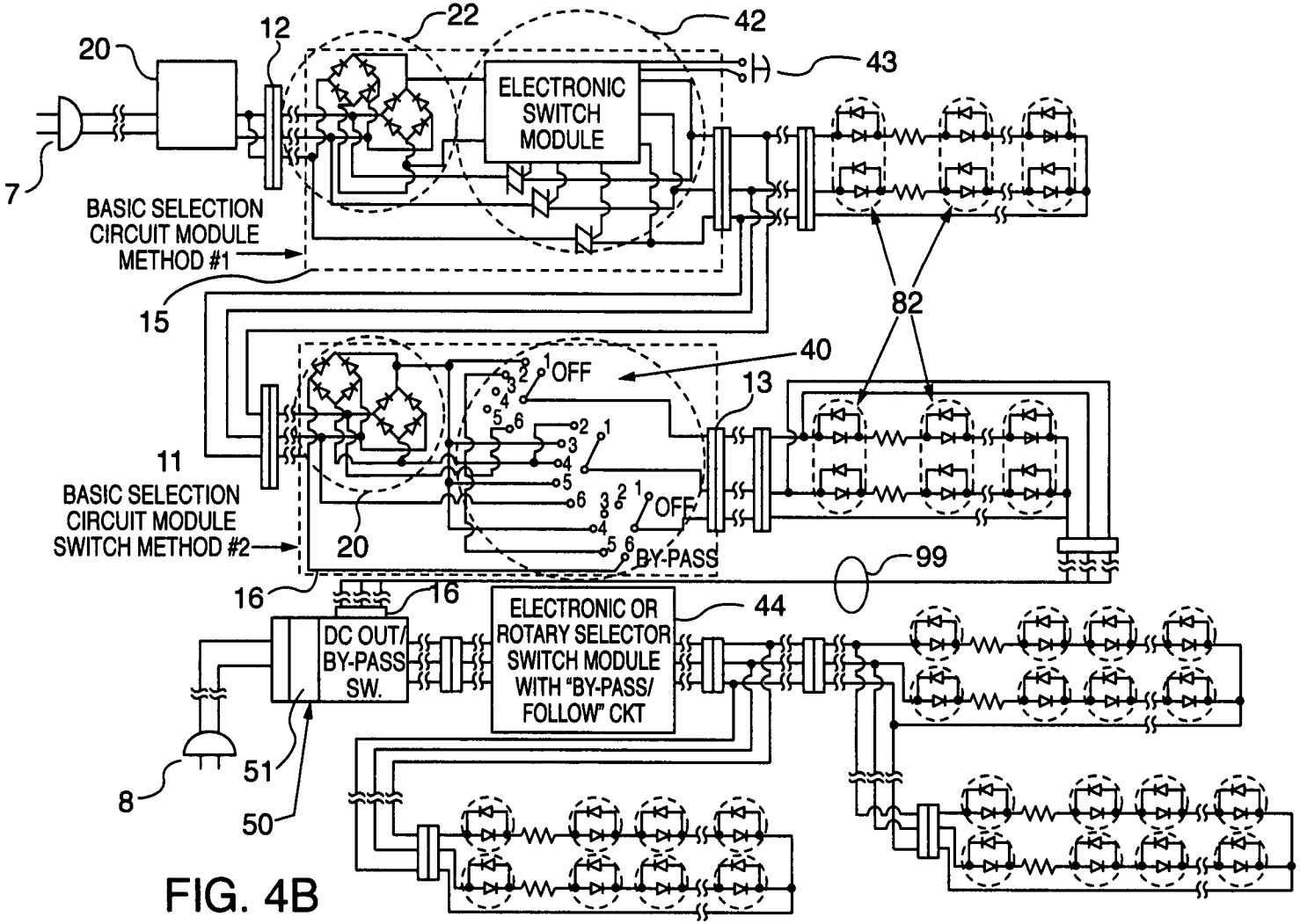

FIGS. 4A and 4B provide circuit schematics for the lighting system operation according to two different embodiments of the invention. In FIG. 4A, power source 7 is shown as a typical 115V AC outlet-supplied power which feeds AC power to the first connector 11 of controller 10 (shown within the dashed lines). Controller 10 is shown connected to the light string 80 at second connector 13. One exemplary light string 80 is shown with eight light elements 82 numbered 1-8. Each of the light elements contains 4 LEDs, arranged in two cross-coupled pairs within the light element as provided in FIG. 2A. For reference, the individual LEDS are labeled A, B, C, and D within each light element. These LED letter designations are also shown in FIG. 2A. In operation, a positive voltage presented on wire 94 with respect to ground wire 100 will bias all the A LEDs in the light elements. A negative voltage presented on wire 94 with respect to ground wire 100 ill bias all the B LEDs in the light elements. Similar operation is obtained with respect to LEDs C and D when positive and negative biases are presented on wire 96 relative to ground wire 100. Additional light strings may be connected at connector 75 which is also connected electrically to second connector 13. First and second connectors 11 and 13 of controller 10 may be polarized so as to maintain proper power and light string connections respectively.

In FIG. 4A, controller 10 includes a Wheatstone bridge 10 for rectifying the input AC voltage to DC voltage. Following rectification, DC signals of varying polarity combinations are provided to a three pole gang switch 40 which is shown in FIG. 4A as having 6 switch positions. The operation of rectifiers, in general, is well known and those of skill in the art are able to determine the proper tap points on the Wheatstone bridge 10 to obtain the proper combination of voltage biases at the 5 switch points within three-pole switch 40. For the purpose of this illustration and description of the system operation, it is sufficient to note that the LEDs of FIG. 4A are biased according to the following switch positions:

| SWITCH POSITION | LEDs BIASED |
|---|---|
| 0 | All off |
| 1 | A |
| 2 | B |
| 3 | C |
| 4 | D |
| 5 | Bypass |

In switch position 0, none of the LEDs are biased, and in switch position 5, the bypass position, the input voltages at pins 17, 18 and 19 bypass the rectifier and switching elements and are presented directly at wires 94, 96 and 100 respectively.

Different arrangements of rectifiers and switches may be used within the controllers of the present invention and other components may be used in conjunction with controller to make the overall controller operation more efficient. As shown in FIG. 4B, supply power 7 is provided to a high-to-low voltage conversion unit 30 so as to provide a low voltage input to the first connectors 11 and 12 of controllers 10 and 15 respectively, thereby making the overall lighting system more safe. Further, controller 15 is shown with a rectifier 22 and switch 42. Selector switch 43 is used to cycle between switched outputs. In this controller however, the rectifier 22 is a double Wheatstone bridge that provides a maximum of eight taps which are fed to an electronic switch module 42. Alternatively, the switch module, as well as the rectifier, may be comprised of integrated circuits or other circuit-based electronics including programmable devices. In any case, the desired combination of bias outputs, including an off and bypass positions, may be generated by the controllers 10 and 15, at second connectors 13 and 14, respectively by any known or later discovered techniques according to the general teachings of the present invention. It should be realized that four LED light elements have a total of eight possible LED bias combinations not including off and bypass. In the case of six LED light elements, 16 such bias combinations are possible.

Also shown in FIG. 4B is a system variation regarding the modularization of the components of the present invention. As seen at the bottom, a power booster plug 50 may also be used to power a light string. In this arrangement, external power 8 provides power to the power booster plug 50 where it is rectified by an AC/DC converter 51. Booster plug 50 accepts the unpowered or low powered bias inputs 99 provided from a coupled light string at booster connector 16. The input bias signals may then be boosted in power by the power booster plug so as to feed the bias inputs to other light string circuit elements such as further light strings or additional controllers 44.

FIG. 5A shows the actual color output 200 of the circuit of FIG. 4A, at least for switch positions 1-4. A more advanced rectification circuit and switch must be used to realize all 8 holiday displays shown in FIG. 5A. First, it should be noted that holiday/switch positions are provided within columns 220. Second, bulb numbers run across rows 260. The key to achieving the purpose of this invention is to properly construct and select the appropriate four LED light element for each light socket in the string. Thus, referring across the row for bulb 1, 241, a light element is needed in which LED A is red, LED B is red, LED C is white and LED D is yellow. Referring across the row for bulb 3, 242, a light element is needed in which LED A is green, LED B is blue, LED C is white and LED D is green. These criteria require that particular four color bulbs be constructed according to these specifications. Further, the bulbs must be inserted properly within the socket. The orientation slots and tabs described above provide one reliable method of achieving proper orientation of the LEDs with respect to socket leads. When all eight sockets are populated with four LED light elements according to the chart of FIG. 5A, the holiday sequences are fully realized. For example, when the four LED light element are so populated and the switch set to position 1, the pattern of RED, BLUE, GREEN, YELLOW, RED, BLUE, GREEN, YELLOW occurs in sequence across light elements 1-8 of FIG. 4A. Likewise, when the four LED light element are so populated and the switch is set to position 5, Halloween, the pattern of ORANGE, LIGHT PURPLE, TURQUOISE, ORANGE, ORANGE, LIGHT PURPLE, TURQUOISE, ORANGE occurs in sequence across light elements 1-8 of FIG. 4A. It is noteworthy that the combination of colored LEDs being biased simultaneously allow for a broader range of color displays.

FIG. 5B shows a similar LED color chart for light strings containing six LEDs. More advanced rectification circuit and switch must be used to realize all sixteen holiday displays possible with 6 LEDs per light element. First, it should be noted that holiday/switch positions are provided within columns 320. Second, bulb numbers run across rows 360. Again, the key to achieving the purpose of this invention is to properly construct and select the appropriate six LED light element for each light socket in the string. Thus, referring across the row for bulb 4, 344, a light element is needed in which LED A is yellow, LED B is white, LED C is white, LED D is orange, LED E is purple, and LED F is white. Through the proper construction, selection and placement of the six LED light elements in sockets 1-8, the holiday color combinations provided in columns 320 are achieved through appropriate switch operation.

One key advantage of this invention is that using a single switch, numerous holiday color schemes are available on a single light string. One of the complications, however, is that highly specific multicolor LED light elements must be manufactured according to the specifications of the color charts in FIGS. 5A and 5B. These construction requirements may be able to be relaxed somewhat if a multi-colored light element could be fabricated, say containing LEDs of each color red, white, yellow, blue, green, purple, and orange. Then, through the proper arrangement of LEDs in connection with the LED leads 74, 75, 76 and 77 of FIG. 3B and the proper use of socket keying, a minimal number of different light elements may need to be constructed while still preserving the diversity of display colors.

Figure 6:
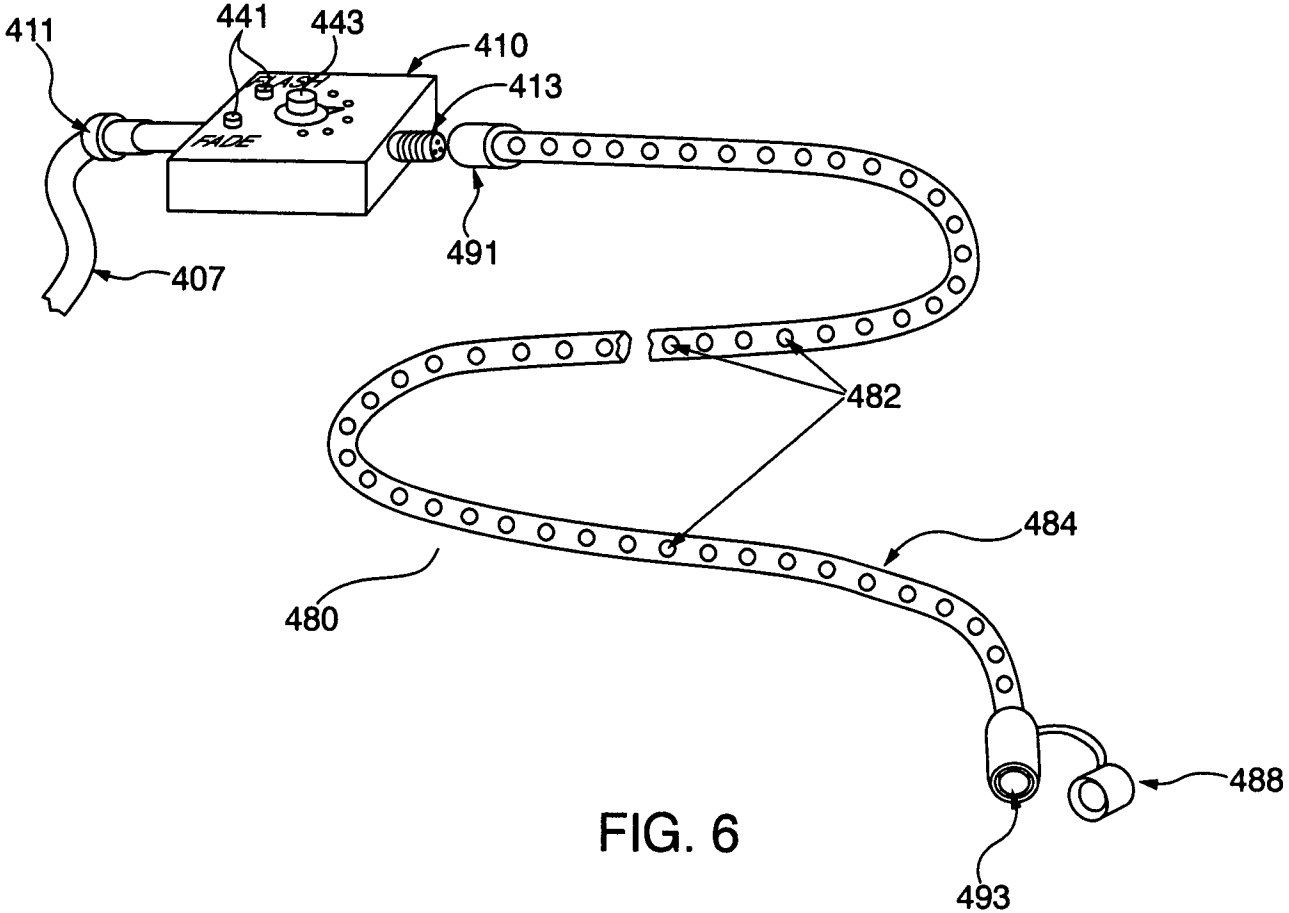
FIG. 6 shows an alternative light string according to a particular embodiment of the invention.

Referring to FIG. 6, a rope light string 480 is provided in which is housed the previously described LED light elements. In this arrangement, the light elements 482 are not exposed directly to the outside air but rather are enclosed in a watertight clear plastic and flexible tube 484. Polarized male and female connectors 493 and 491 respectively are disposed at opposite end of the rope light string for electrical connection to power sources and other rope light strings. A watertight cap 488 may be provided at an open end to ensure watertight encasement of the rope light string at an unconnected end. Controller 410 is provided for the usual function of rectifying AC power to DC power from power source 407 and switching the bias control signals via multi-pole switch 440 and coupled control knob 443. Controller 410 is connected to the power source at polarized plug 411 and the rope light string at polarized plug 413. Additional, optional control features may be included within the controller 410 such as a button or buttons 441 that cause the light elements in the light string to fade and/or flash.

Figure 7A:
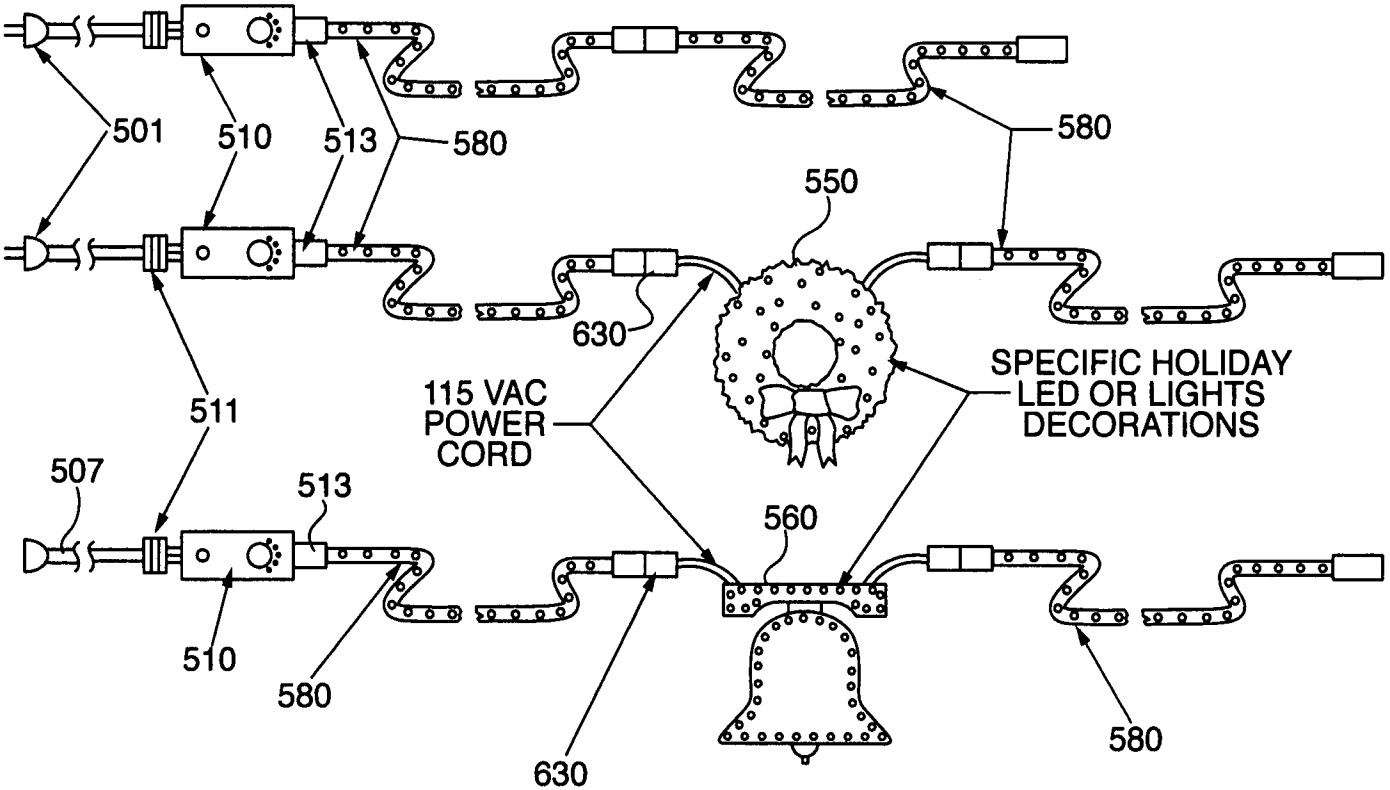
FIGS. 7A & 7B show various modular lighting systems containing a variety of alternative elements according to particular embodiments of the invention.
Figure 7B:
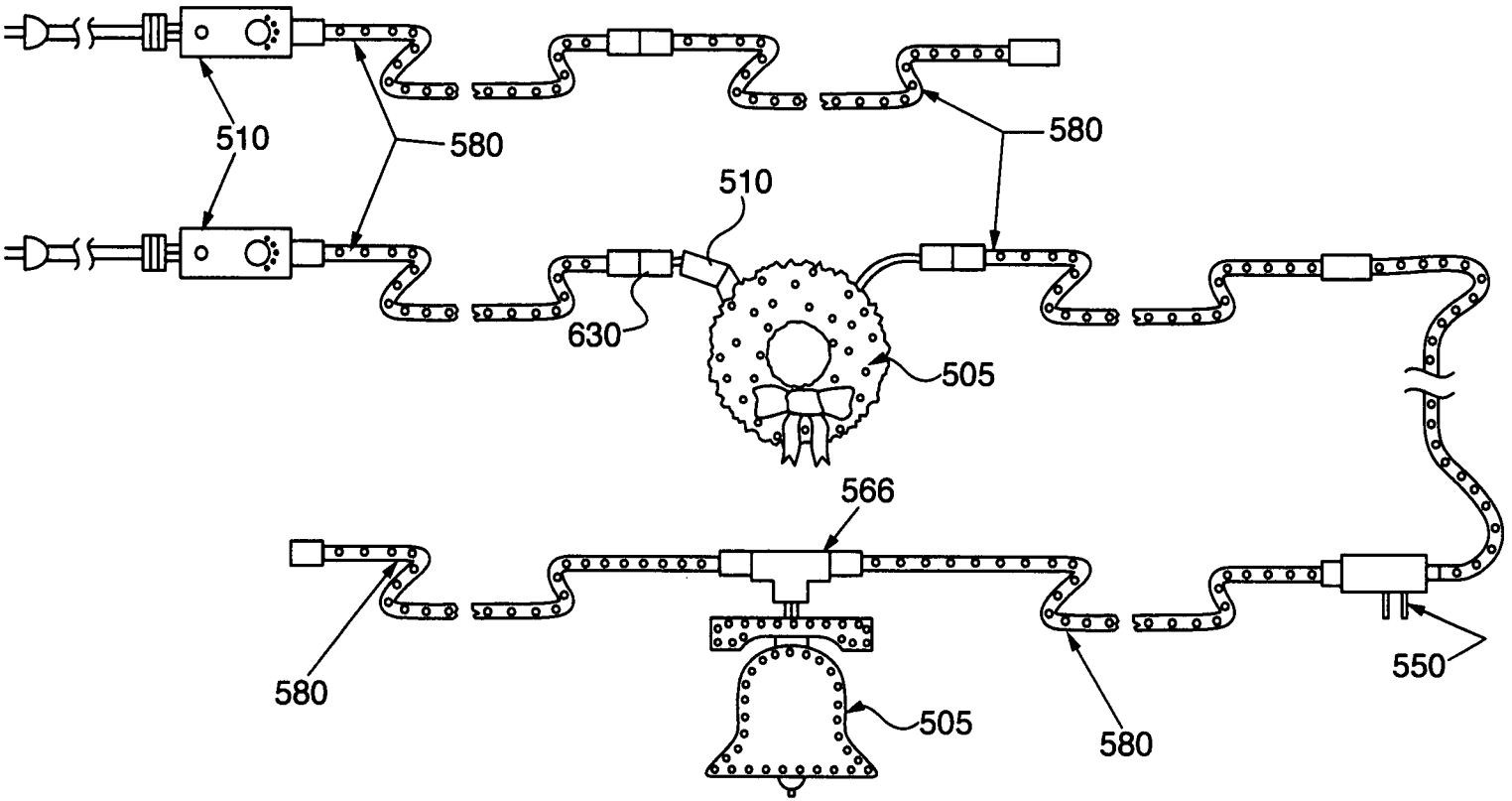

Referring to FIGS. 7A and 7B, various interconnections of the all holiday lighting systems are disclosed. In FIG. 7A, control modules 510 of the type previously described are coupled to electric power 507 at polarized connectors 511. In each of the three systems shown in FIG. 7A, the controllers are coupled to a four-color rope light strings 580 at second controller connector 513. In the top system, the LED-lit first rope light string is connected to and sequentially followed by a second LED-lit rope light string. In the middle and bottom systems, typical 115V AC ornaments are inserted between the two LED-lit rope light strings. In a preferred aspect, these lighted ornaments can be holiday specific, such as the lighted wreath 550 shown in the middle system and the liberty bell display 560 shown in the bottom system. If the inserted decoration is only to go on at certain holidays, as selected at the controller, then modular adapter elements are required to provide power, e.g. 630 as described in connection with FIG. 8 below. Notwithstanding specific lighting requirements, modular adapters are needed to provide power to the two prong NEMA power cords that are typically plugged into 115V AC and are not compatible with the male/female connectors used within the LED-lit display systems of the present invention.

Inserted, holiday specific decorations may also be constructed of the same LED lighting elements disclosed above, in which case the connectors to these specific holiday decorations may be the standard connection provided by the rope light strings, e.g. 491/493. Alternatively, specific adapters, such as "T" adapter 566 of FIG. 7B, may be constructed so as to provide connection to the ornament while passing the bias control signals on to subsequent elements. Finally, the inserted holiday specific lighted ornaments may be a fully configured, stand alone LED lighted system with its own controller, e,g, the wreath of FIG. 7B. In this case, the controller 510 associated with that ornament is simply set to bypass and the ornament becomes another element in the series-connected light string. Finally, plug in power boosters, 550 may be inserted anywhere in the series connection to provide additional power, particularly over long series-connected lighting runs.

Figure 8:
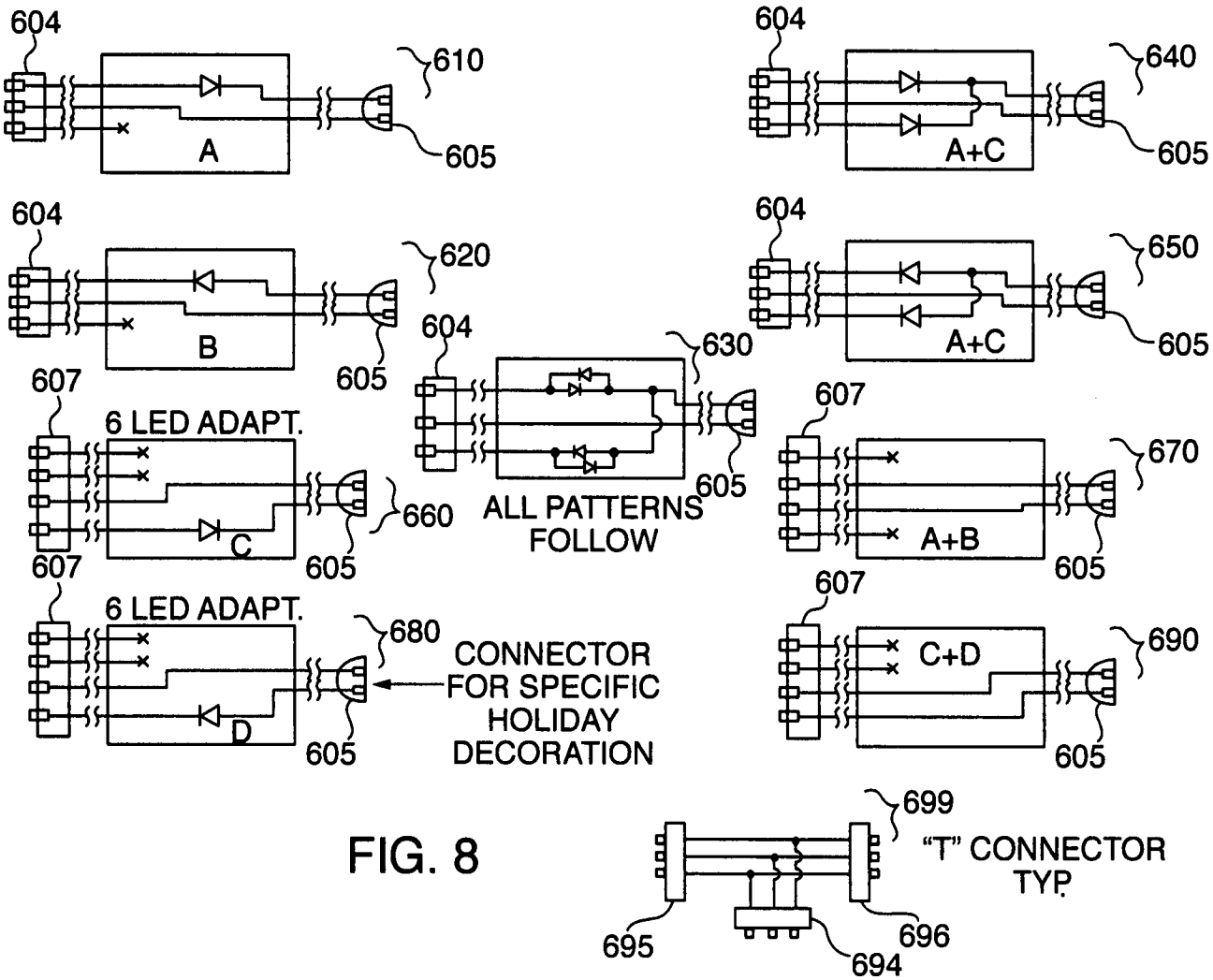
FIG. 8 shows a plurality of modular adapters of for use in interconnecting lighting elements according to particular embodiments of the invention.

FIG. 8 provides a group of four-LED and six-LED modular adapters that may be used to accommodate various elements within the LED lighting systems shown in FIGS. 7A & 7B. With respect to the four-LED adapters 610, 620, 630, 640, 650, the three wire bias control signals are provided to the adapter at the typical LED system male connector 604, equivalent to connector 104 of FIG. 1A or 493 of FIG. 6. Output from the adapters are two wire converted signals at two prong NEMA plug type 605. The pass through function is shown within the adapter for each of the four-LED adapters. For example, a DC positive bias signal that biases the A diodes are passed by adapter 610 to two-pronged output 605. All other bias sequences are not passed by that adapter. A DC positive bias signal that biases the B diodes are passed by adapter 620, A+C biases are passed by adapter 640, B+D biases are passed by adapter 650, and all patterns biases are passed by adapter 630. Again each of the outputs of these adapters is provided on a standard two prong output plug for attaching non-LED light string ornaments that will be lit by the appropriate switch positions. Although all possible combinations are not illustrated, those of skill in the art should be able to take the teachings of this application and construct the required circuitry to create any desired bias adapter. Further, any of the adapters may be supplemented by connecting connector 604 to connector 694 of the "T" adapter 699. Use of the "T" type connector in combination with the conversion adapter permits the three wire bias signaling at connector 695 to be passed straight to an output 696, while also providing the conversion function along the stem portion of the T connection which contains one of the adapters. This arrangement prevents bias signal blockage downstream from the adapter.

Also shown in FIG. 8 are similar modular adapters for the six-LED lighting system. With respect to the six-LED adapters 660, 670, 680, and 690, the four wire bias control signals are provided to the adapter at the typical LED system male connector 607. Output from the adapters are two wire converted signals at two-prong NEMA plug type 605. The pass through function is shown within the adapter for each of the six-LED adapters. For example, a DC positive bias signal that biases the C diodes are passed by adapter 660 to two-pronged output 605. All other bias sequences are not passed by that adapter. A DC positive bias signal that biases the D diodes are passed by adapter 680, A+B biases are passed by adapter 670, and C+D biases are passed by adapter 690. Again each of the outputs of these adapters is provided on a standard two prong output plug for attaching non-LED light string ornaments that will be lit by the appropriate switch positions. Although all possible combinations are not illustrated, those of skill in the art should be able to take the teachings of this application and construct the required circuitry to create any desired bias adapter.

Figure 9:
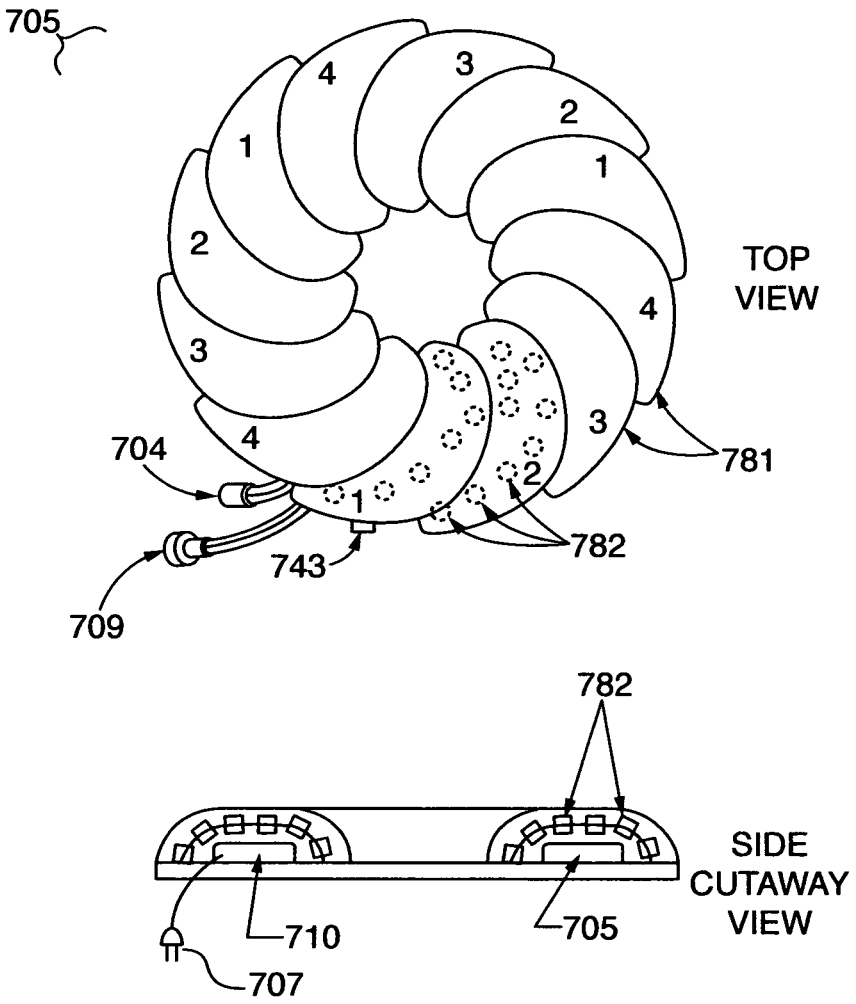
FIG. 9 shows an LED-lighted decoration according to a particular embodiment of the invention.

Referring to FIG. 9, an LED-lit wreath 705 is shown constructed of the four-LED light string technology of the present invention. As with other decorations, the wreath may have typical feed and pass-through connectors 704 and 709 so as to allow the wreath to be inserted into a series LED light connection as shown in FIGS. 7A & 7B. Alternatively, battery packs 705 or power plug 707 may be used to provide power to the wreath. Controller 710 is present to provide for rectification (as needed) and switching using control switch 743. Opaque plastic sections 781, or leaves, are interleaved in a layered fashion to create the effect of a complete wreath composed of petals. In this ornament, the LEDs 782 are embedded in the opaque plastic sections in such a way that each leaf illuminates as if the leaf itself was an individual light element. The repeated numbering of the leaves, 1-4 serves to indicate that each of the LEDs in each leaf functions like one of the first four light elements in a light string sequence, such as shown in FIGS. 4A and 5A. Thus all the LEDs in leaf 1 are type 1 LED bulbs 782, and so on for leaves 2-4. Based on the patterns shown in FIG. 5A, the visual appearance of the wreath 705 during its operation is unique in character.

Figure 10:
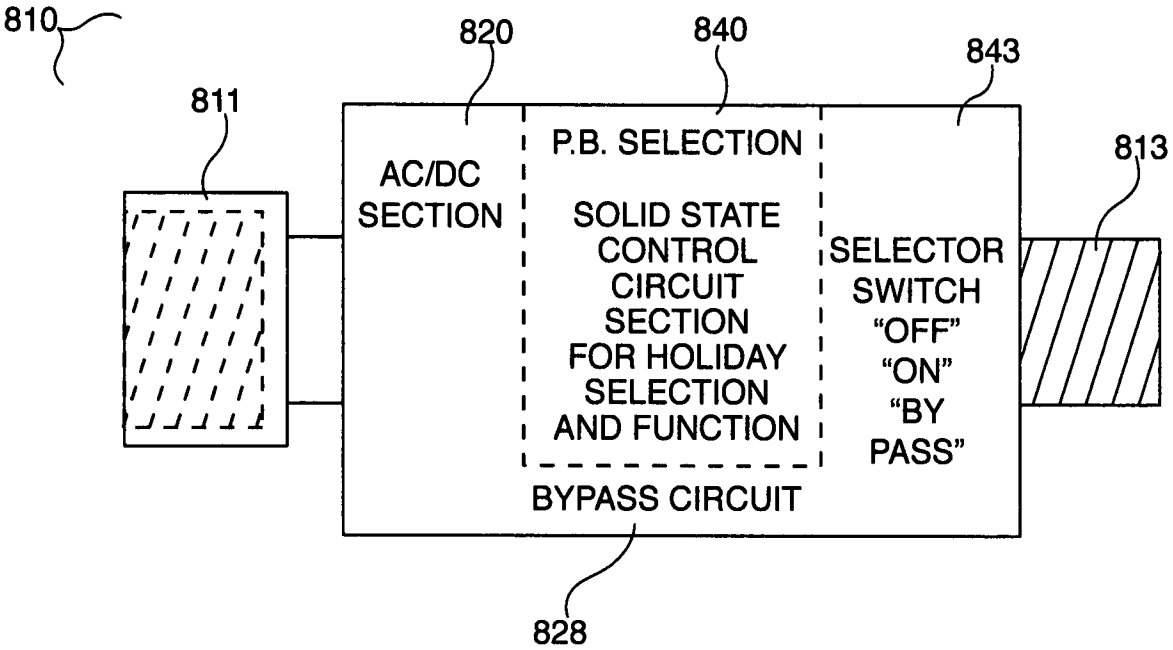
FIG. 10 shows a solid state controller for use with the lighting elements according to a particular embodiment of the invention.

Referring to FIG. 10, a solid state controller 810 is shown. Solid-state controller is composed almost entirely of integrated circuits and/or program-controlled modules. Standard male connector 813 is provided for connection for connection to light strings and/or other LED display elements. Standard female connector 811 is provided for connection to a power or bias signal source. Within the controller 810 are block circuit sections or program modules that perform all the aforementioned functions: AC/DC rectification 820, switching function 840 for LED bias signal generation and bypass signal transmittal 828. Externally accessible selector switch for making a switching selection 843 is also provided on the housing of controller 810 in any of a variety of physical formats, e.g. multi-pole switch, push button cycling switch, LED touch display, etc.

Figure 11A:
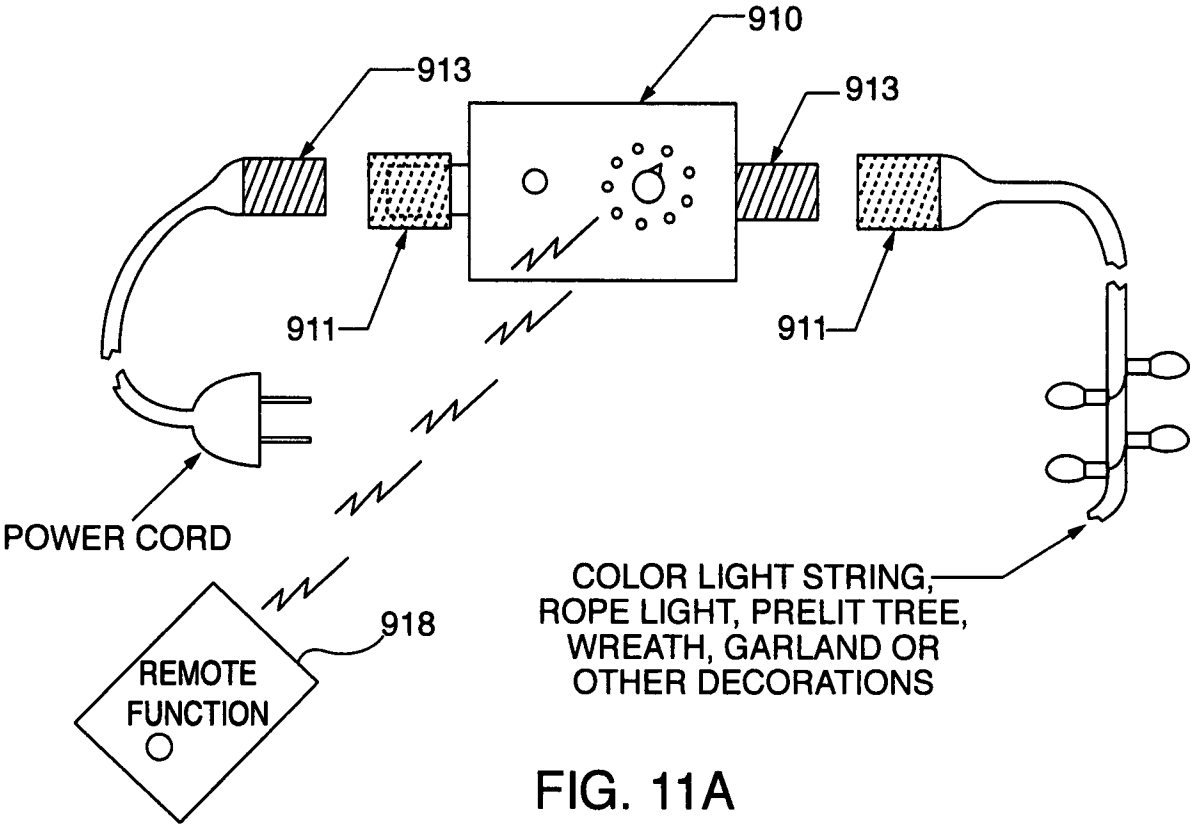
FIGS. 11A & 11B show variations of wireless control functions for use with the lighting elements according to a particular embodiment of the invention.
Figure 11B:
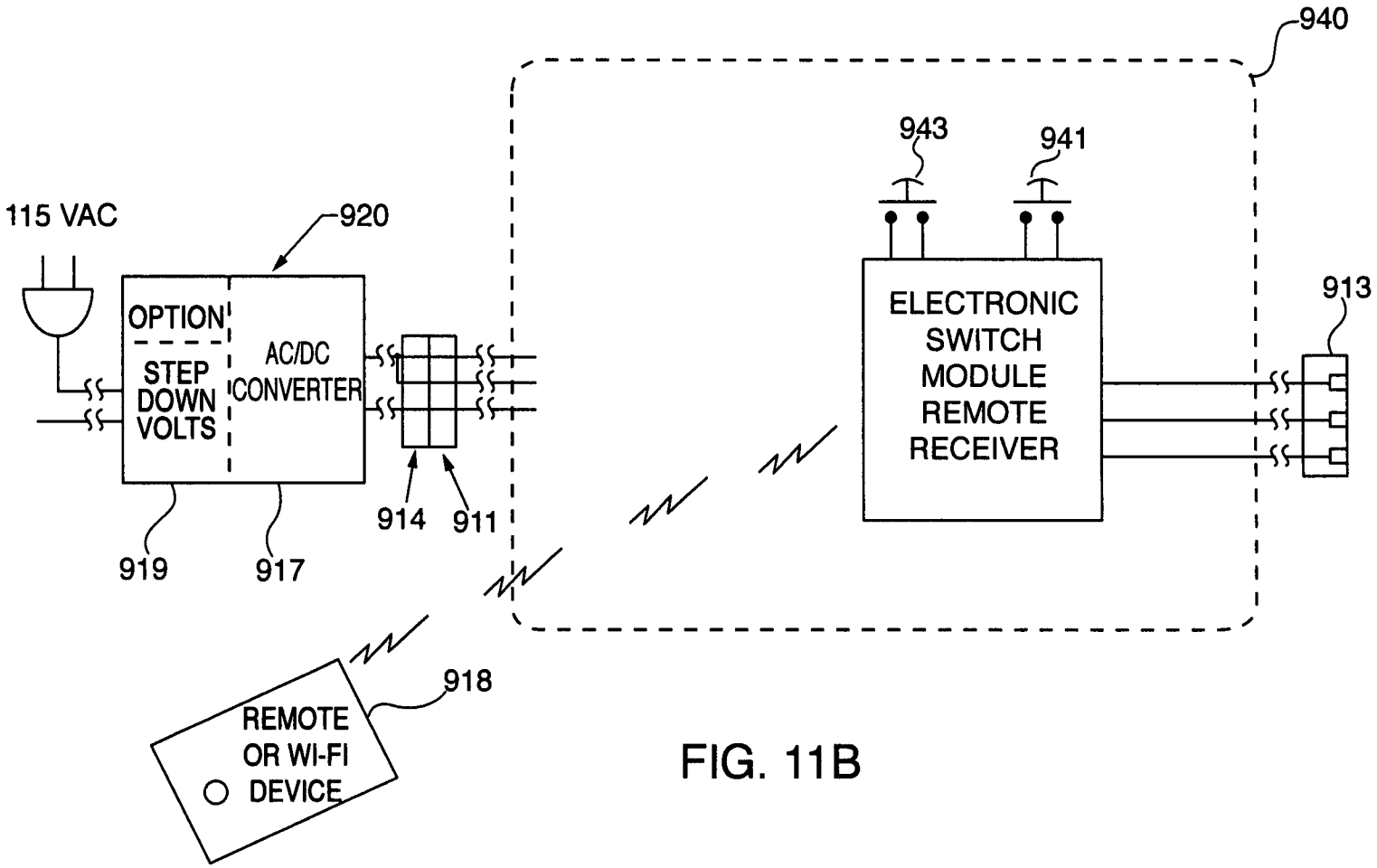

FIGS. 11A and 11B illustrate the remote control operation of the switching function of the controller 910 through remote controller 918. Water tight, screw-in male connectors 913 having three individual electrical connections within them (such as provided by leads 114, 116 and 110 of FIG. 1) are coupled to female sheath connectors 911 via threaded engagement. Controller 910 has at least a wireless receiver for receiving switching signals from a transmitter in the remote controller 918. If controller status is to be returned to the remote controller for display thereon, then both the controller and remote controller may have bidirectional wireless communication means. The wireless communication protocol employed may be any of the known or future developed protocols, some currently popular technologies of which include RF signaling, Wi-Fi, Bluetooth etc.

FIG. 11B shows the same use of a remote controller 918 to operate (optionally) the electronic switching function. In the arrangement of FIG. 11B, however, two discrete modules are provided for the rectification 920 and switching 940 functions. Rectification module 920 may include a high-to-low voltage conversion module 919 followed by an AC/DC conversion at module 917. Connection between the rectification module 920 and switching module 940 is made at connectors 914 and 911. As with the control module in FIG. 11A, switching module 940 may have a bidirectional transceiver to receive commands from and report status to the remote control device 918. Separate switches may also be provided on switching module 940 to make the proper holiday selection, 943, as well as providing additional display effects, 941, such as fade and flash. All of these functions, including the additional effects, can be controlled by the remote control 918.

Figure 12:
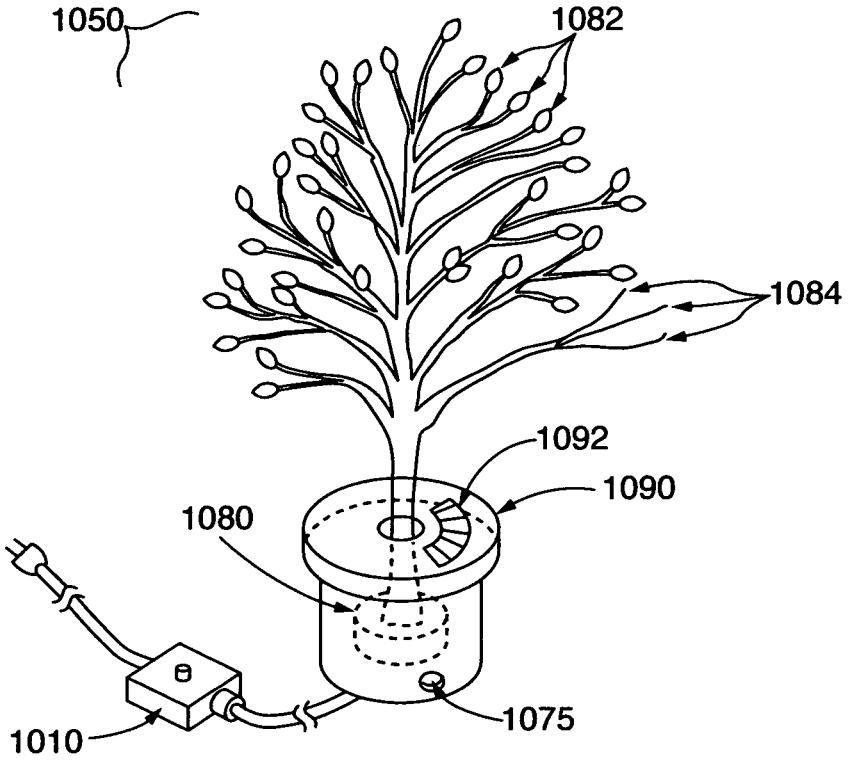
FIG. 12 shows a LED ornament for use with the lighting elements according to a particular embodiment of the invention.

Referring to FIG. 12, another LED decoration 1050 is shown as an LED lighted tree. The tree 1050 has LEDs 1082 as leaves with optional optical fibers 1084 extending through the branches from the base container 1090. The optical fibers are lit by an illumination module 1080, which is composed of extra bright LEDs in one embodiment of the invention. Illumination module 1080 is contained within base container 1090. A solar panel 1092 may optionally be included as an alternate power source for an outdoor ornament. A plug 1075 is included for adding on additional LED lighted segments. Modular controller 1010 is provided to accommodate the rectification and switching functions (or providing bypass) as described above.

While the invention has been shown and described with reference to specific preferred embodiments, it should be understood by those skilled in the art that various changes in form and detail may be made therein without departing from the spirit and scope of the invention as defined by the following claims.

What is claimed is:

1. A lighting system comprising:

a controller coupled to a power source at a first connection and at least one light string at a second connection, said second connection including at least three connection leads, said second connection being polarized such that said light string is capable of only one connection orientation at said second connection, said light string containing a plurality of lighting elements, each of said lighting elements containing a plurality of different colored lights, said controller having a switch with a plurality of switch positions including:

a first switch position for providing electrical power at said second connection to said light string by applying a first voltage phase on a first connection lead, said first voltage phase biasing a first light among said plurality of different colored lights within said lighting elements;

a second switch position for providing electrical power at said second connection to said light string by applying a second voltage phase on said first connection lead, said second voltage phase biasing a second light among said plurality of different colored lights within said lighting elements; and a third switch position for providing electrical power at said second connection to said light string in a third voltage phase on a second connection lead, said third voltage phase biasing a third light among said plurality of different colored lights within said lighting elements.

2. The system of claim 1 wherein said plurality of different colored lights are multicolored LEDs and said lighting element is a bulb containing said multicolored LEDs.

3. The system of claim 1 further comprising a fourth switch position for providing electrical power at said second connection to said light string by simultaneously applying said first voltage phase on said first connection lead and said second voltage phase on said second connection lead, said plurality of applied voltage phases biasing a plurality of said different colored lights within of said lighting elements.

4. The system of claim 3 wherein said lighting element includes a diffusion element for blending said colors of said plurality of biased lights.

5. The system of claim 1 wherein said light string includes sockets for receiving said lighting elements, said sockets and said lighting elements including an orientation mechanism used to govern the proper insertion of said lighting elements into said sockets.

6. The system of claim 5 wherein said connection mechanism permits a plurality of orientations of said light element within said socket.

7. The system of claim 1 wherein said controller includes a bypass switch position, said bypass switch position applying the same biasing voltages present at connection leads of said first connection to said connection leads of said second connection.

8. The system of claim 1 wherein said controller includes a rectifier for converting AC voltage input at said first connection to DC voltage to said switch for providing said biasing voltage phases.

9. The system of claim 1 further including an adapter, said adapter used to convert said at least three connection leads to a standard two prong NEMA plug coupling to accommodate existing holiday decorations within said system.

10. The system of claim 1 further including an ornament including a plurality of lighting elements, each of said lighting elements containing a plurality of different colored lights, said ornament coupled to said controller at another second connection, a first, second and third light among said plurality of different colored lights being biased in combination with said first, second and third light among said plurality of different colored lights on said light string.

11. A light string comprising:

a connection including at least three connection leads, said connection being polarized such that said light string is capable of only one connection orientation to a controller, said light string containing a plurality of lighting elements, each of said lighting elements containing a plurality of different colored lights, said light string being operable by said controller wherein said controller has a switch with a plurality of switch positions including:

a first switch position for providing electrical power at said connection to said light string by applying a first voltage phase on a first connection lead, said first voltage phase biasing a first light among said plurality of different colored lights within said lighting elements;

a second switch position for providing electrical power at said connection to said light string by applying a second voltage phase on said first connection lead, said second voltage phase biasing a second light among said plurality of different colored lights within said lighting elements; and a third switch position for providing electrical power at said connection to said light string in a third voltage phase on a second connection lead, said third voltage phase biasing a third light among said plurality of different colored lights within said lighting elements.

12. The light string of claim 11 wherein said plurality of different colored lights are multicolored LEDs and said lighting element is a bulb containing said multicolored LEDs.

13. The light string of claim 11 wherein said controller includes a fourth switch position for providing electrical power at said connection to said light string by simultaneously applying said first voltage phase on said first connection lead and said second voltage phase on said second connection lead, said plurality of applied voltage phases biasing a plurality of said different colored lights within of said lighting elements.

14. The light string of claim 11 wherein said lighting element includes a diffusion element for blending said colors of said plurality of biased lights.

15. The light string of claim 11 wherein said light string includes sockets for receiving said lighting elements, said sockets and said lighting elements including an orientation mechanism used to govern the proper insertion of said lighting elements into said sockets.

16. The light string of claim 15 wherein said connection mechanism permits a plurality of orientations of said light element within said socket.

17. A method for operating a light string comprising:

coupling a controller to a power source at a first connection of said controller;

coupling said controller to at least one light string at a second connection of said controller, said second connection including at least three connection leads, said second connection being polarized such that said light string is capable of only one connection orientation at said second connection, said light string containing a plurality of lighting elements, each of said lighting elements containing a plurality of different colored lights, said controller having a switch with a plurality of switch positions;

switching said controller to a first switch position, said first switch position providing electrical power at said second connection to said light string in a first voltage phase on a first connection lead, said first voltage phase biasing a first colored light within said plurality of different colored lights;

switching said controller to a second switch position, said second switch position providing electrical power at said second connection to said light string in a second voltage phase on said first connection lead, said second voltage phase biasing a second colored light within said plurality of different colored lights; and switching said controller to a third switch position, said third switch position providing electrical power at said second connection to said light string in a third voltage phase on a second connection lead, said third voltage phase biasing a third colored light within said plurality of different colored lights.

18. The method of claim 17 further comprising switching said controller to a fourth switch position, said fourth switch position providing electrical power at said second connection to said light string by simultaneously applying said first voltage phase on said first connection lead and said second voltage phase on said second connection lead, said plurality of applied voltage phases biasing a plurality of said different colored lights within of said lighting elements.

* * * * *